US007360870B2

(12) United States Patent
Goto et al.

(10) Patent No.: US 7,360,870 B2
(45) Date of Patent: Apr. 22, 2008

(54) NOZZLE PLATE FOR HIGH-RESOLUTION INKJET PRINT HEAD

(75) Inventors: Satoru Goto, Nagoya (JP); Atsushi Ito, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 374 days.

(21) Appl. No.: 11/065,124

(22) Filed: Feb. 24, 2005

(65) Prior Publication Data

US 2005/0185019 A1 Aug. 25, 2005

(30) Foreign Application Priority Data

Feb. 24, 2004 (JP) ..... 2004-048412
Feb. 24, 2004 (JP) ..... 2004-048413

(51) Int. Cl.
*B41J 2/14* (2006.01)
*B41J 2/16* (2006.01)

(52) U.S. Cl. ..... 347/47; 347/68; 347/71

(58) Field of Classification Search ..... 347/20, 347/44, 47, 67, 68, 70, 71, 40
See application file for complete search history.

(56) References Cited

U.S. PATENT DOCUMENTS 6,170,934 B1 1/2001 Fujisawa et al. ..... 347/47
6,969,158 B2 * 11/2005 Taira ..... 347/70

FOREIGN PATENT DOCUMENTS

JP A-10-226070 8/1998
JP A-2001-322281 11/2001

* cited by examiner

*Primary Examiner*—Juanita D. Stephens
(74) *Attorney, Agent, or Firm*—Oliff & Berridge, PLC

(57) ABSTRACT

A method manufactures a nozzle plate from a substrate with using a punch group including a plurality of punches. A nozzle group has plural nozzle rows in each of which plural nozzle holes are arranged at predetermined intervals in a predetermined direction. Plural nozzle-row sets are defined to each contain at least two nozzle rows having predetermined relative positional relationship with each other. The punch group has plural punch rows each corresponding to one of the nozzle rows contained in each nozzle-row set. Punches on each punch row are arranged at intervals equivalent to the predetermined intervals. The method includes forming a first hole group in the substrate with using the punch group; moving the substrate relative to the substrate in a first direction, which crosses the predetermined direction; and forming a second hole group in the substrate with using the punch group.

8 Claims, 23 Drawing Sheets

NOZZLE PLATE FOR HIGH-RESOLUTION INKJET PRINT HEAD

BACKGROUND OF THE INVENTION

1. Background of the Invention

The present invention relates to a method for manufacturing a nozzle plate in which nozzles used for ejecting ink are formed, and to a nozzle plate manufactured by the manufacturing method.

2. Description of the Related Art

JP-A-Hei.10-226070 describes a technique for manufacturing a nozzle plate in which nozzle holes are formed, by means of pressing a hoop member, which is to become a nozzle plate, through use of a metal mold, wherein punches used for forming nozzle holes are arranged at uniform intervals on the metal mold in a paper feed direction and a plurality of punch rows are also arranged on the metal mold in a direction orthogonal to the paper feed direction. According to this manufacturing method, the hoop material is pressed by means of the metal mold, to thus form nozzle blind holes. The hoop material is then moved in the paper feed direction and positioned such that the punches on the metal mold face spaces between the nozzle blind holes. The hoop material is again pressed by means of the metal mold. Dowels having been projected by the nozzle blind holes are removed through abrasion, and the continuous hoop material is cut, to thus manufacture nozzle plates in which a plurality of nozzle holes are formed. Thus, the hoop material is twice subjected to pressing through use of a single metal mold, so that a nozzle plate in which a desired number of nozzle holes are formed can be manufactured with use of punches in a number of punches about half that of the nozzle holes to be formed in the nozzle plate. The number of punches implanted on the metal mold can be made smaller than the number of nozzle holes, and hence the cost of the metal mold can be curtailed.

SUMMARY OF THE INVENTION

However, according to the technique described in JP-Hei.10-226070, the hoop material is fed in only one direction parallel to the paper feed direction. For this reason, the nozzle holes, which are formed by means of the punches of the metal mold and are larger in number than the punches of the metal model, are formed in only one direction (a direction aligned in the nozzle rows). Thus, a layout pattern made by the plurality of nozzle holes formed on the nozzle plate has no degree of freedom. A nozzle plate of an inkjet head, which has a layout pattern featuring a plurality of nozzle rows arranged in parallel and enables high-resolution printing, cannot be formed.

In a case where a plurality of nozzle holes are formed through pressing by means of moving a metal mold having only one punch in a direction parallel to the plane direction of the nozzle plate, the nozzle holes can be formed in an arbitrary layout pattern. However, only one nozzle hole can be formed by a single pressing action, and hence manufacture of a nozzle plate involves consumption of much time, thereby yielding a problem of increased cost.

Accordingly, the present invention aims at providing a method for manufacturing a nozzle plate of an inkjet head, which is of low cost, has a plurality of nozzle rows, and enables high-resolution printing, as well as providing a nozzle plate manufactured by the manufacturing method.

According to one embodiment of the invention, a method manufactures a nozzle plate from a substrate with using a punch group including a plurality of punches. The nozzle plate has a nozzle group in which nozzle holes are arranged two-dimensionally. The nozzle group has a plurality of nozzle rows in each of which a plurality of nozzle holes are arranged at predetermined intervals in a predetermined direction. A plurality of nozzle-row sets are defined so as to each contain at least two nozzle rows, which have a predetermined relative positional relationship with each other. The punch group has a plurality of punch rows each corresponding to one of the nozzle rows contained in each nozzle-row set. Punches on each punch row are arranged at intervals equivalent to the predetermined intervals. The method includes forming a first hole group in the substrate with using the punch group; after the forming of the first hole group, moving the substrate relative to the substrate in a first direction, which crosses the predetermined direction; and after the moving of the substrate in the first direction, forming a second hole group in the substrate with using the punch group.

According to this method, a nozzle plate manufactured is configured to have the plurality of nozzle-row sets each containing the at least two nozzle rows having the predetermined relative positional relationship with each other. The punch group used to form the nozzles has the plurality of punch rows each corresponding to one of the nozzle rows contained in each of the nozzle-row sets. The interval between the punches on each punch row is made equal to the predetermined interval between the nozzle holes on each nozzle row. Therefore, the nozzle plate of an inkjet head, which has a plurality of nozzle rows and can perform high-resolution printing, can be formed through a smaller number of steps. By means of this method, the nozzle plate can be formed in a comparatively smaller number of steps while reducing cost a mold. Thus, there can be realized a manufacturing method, which reduces, in a balanced manner, labor costs stemming from the number of processes, and cost of a metal mold stemming from the number of punches.

According to one embodiment of the invention, a nozzle plate includes a plurality of nozzle groups of a trapezoid, each of the nozzle groups in which a plurality of nozzles for ejecting ink are arranged two dimensionally within the trapezoid on an ink ejection surface; and a plurality of dummy holes. Each of the nozzle groups has a plurality of nozzle rows in which a plurality of nozzle holes are arranged in a direction of a long side of the trapezoid at predetermined intervals. The nozzle groups are arranged so that the long sides thereof are parallel to each other. Oblique sides of adjacent nozzle groups face each other to be parallel to each other. The oblique sides of the adjacent nozzle groups partially overlap each other when viewed from a direction, which is perpendicular to the long sides and is on the ink ejection surface. When the nozzle holes of the nozzle groups are projected from a predetermined direction onto a virtual line, which is on a plane including the ink ejection surface and is parallel to the long sides, projection points of the nozzle holes are arranged at even intervals on the virtual line. The predetermined direction is parallel to the plane including the ink ejection surface. The dummy nozzles are arranged on an extension line of the nozzle rows and are located outside the trapezoids of the nozzle groups.

According to this nozzle plate, the dummy nozzles formed on the extension line of each nozzle row can be formed in an area outside the trapezoid where a trapezoidal nozzle group for ejecting ink is formed, without interrupting an image recorded by the ink ejected from nozzle holes of a plurality of trapezoidal nozzle groups. Even when the nozzle plate is manufactured by the manufacturing method involving generation of dummy nozzles, there is realized a nozzle plate of a high-resolution head having a trapezoidal nozzle group where a plurality of nozzles are two-dimensionally arranged.

According to one embodiment of the invention, a method manufactures a nozzle plate from a substrate with using a punch group including a plurality of punches. The nozzle plate has a nozzle group in which nozzle holes are arranged two-dimensionally. The nozzle group has a plurality of nozzle rows in each of which a plurality of nozzle holes are arranged at predetermined intervals in a predetermined direction. A plurality of nozzle-row sets are defined so as to each contain at least two nozzle rows, which have a predetermined relative positional relationship with each other. The punch group has a plurality of punch rows each corresponding to one of the nozzle rows contained in each nozzle-row set. Punches on each punch row are arranged at intervals equivalent to an integral multiple of the predetermined intervals, the integral being equal to or larger than two. The method includes forming a first hole group in the substrate with using the punch group; after the forming of the first hole group, moving the substrate relative to the substrate in a first direction, which is parallel to the predetermined direction; after the moving of the substrate in the first direction, forming a second hole group in the substrate with using the punch group; after the forming of the second hole group, moving the substrate relative to the substrate in a second direction, which crosses the first direction; and after the moving of the substrate in the second direction, forming a third hole group in the substrate with using the punch group.

According to this nozzle plate, the dummy nozzles formed on the extension line of each nozzle row can be formed in an area outside the trapezoid where a trapezoidal nozzle group for ejecting ink is formed, without interrupting an image recorded by the ink ejected from nozzle holes of a plurality of trapezoidal nozzle groups. Even when the nozzle plate is manufactured by the manufacturing method involving generation of dummy nozzles, there is realized a nozzle plate of a high-resolution head having a trapezoidal nozzle group where a plurality of nozzles are two-dimensionally arranged.

DETAILED DESCRIPTION OF THE PREFERRED EMBODIMENTS

Preferred embodiments of the present invention will be described hereinbelow by reference to the drawings.

First Embodiment

<Overall Structure of an Inkjet Head>

Figure 1:
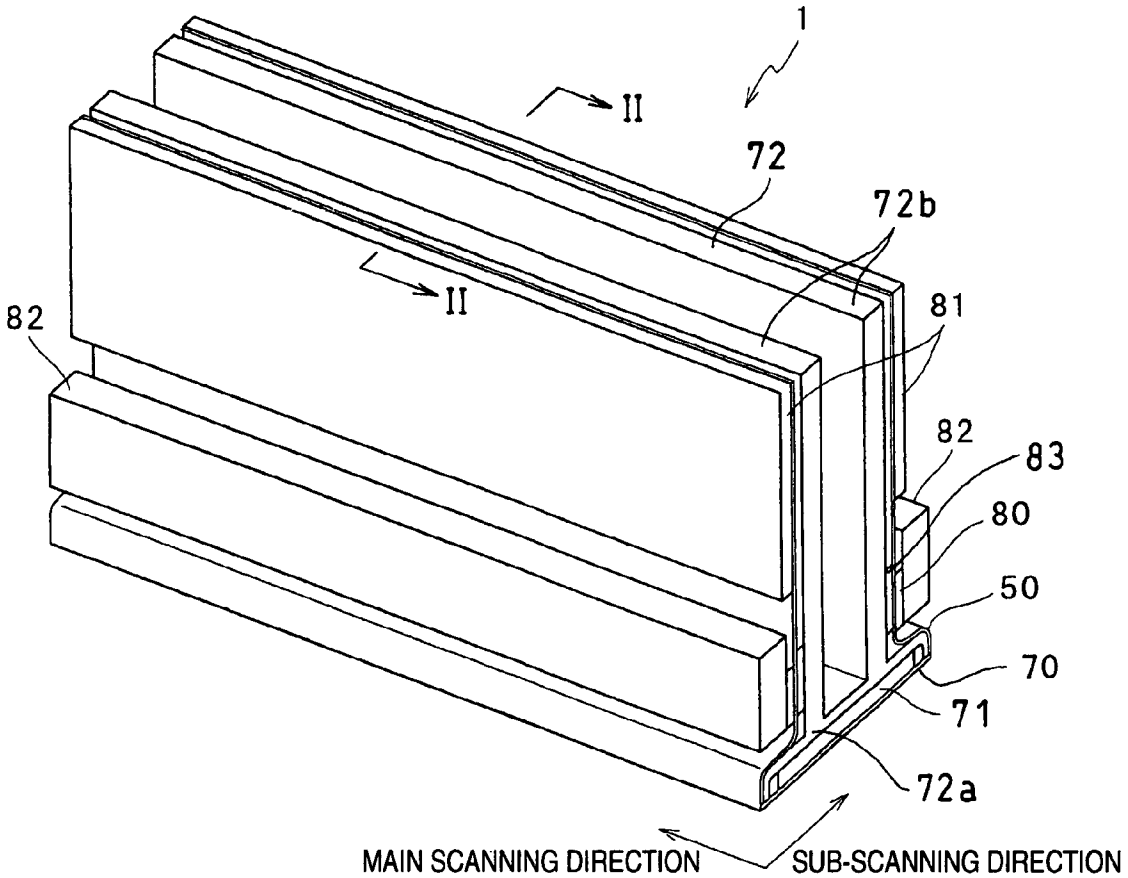
FIG. 1 is an external perspective view of an inkjet head to which is applied a nozzle plate manufactured by a manufacturing method according to a first embodiment of the present invention.
Figure 2:
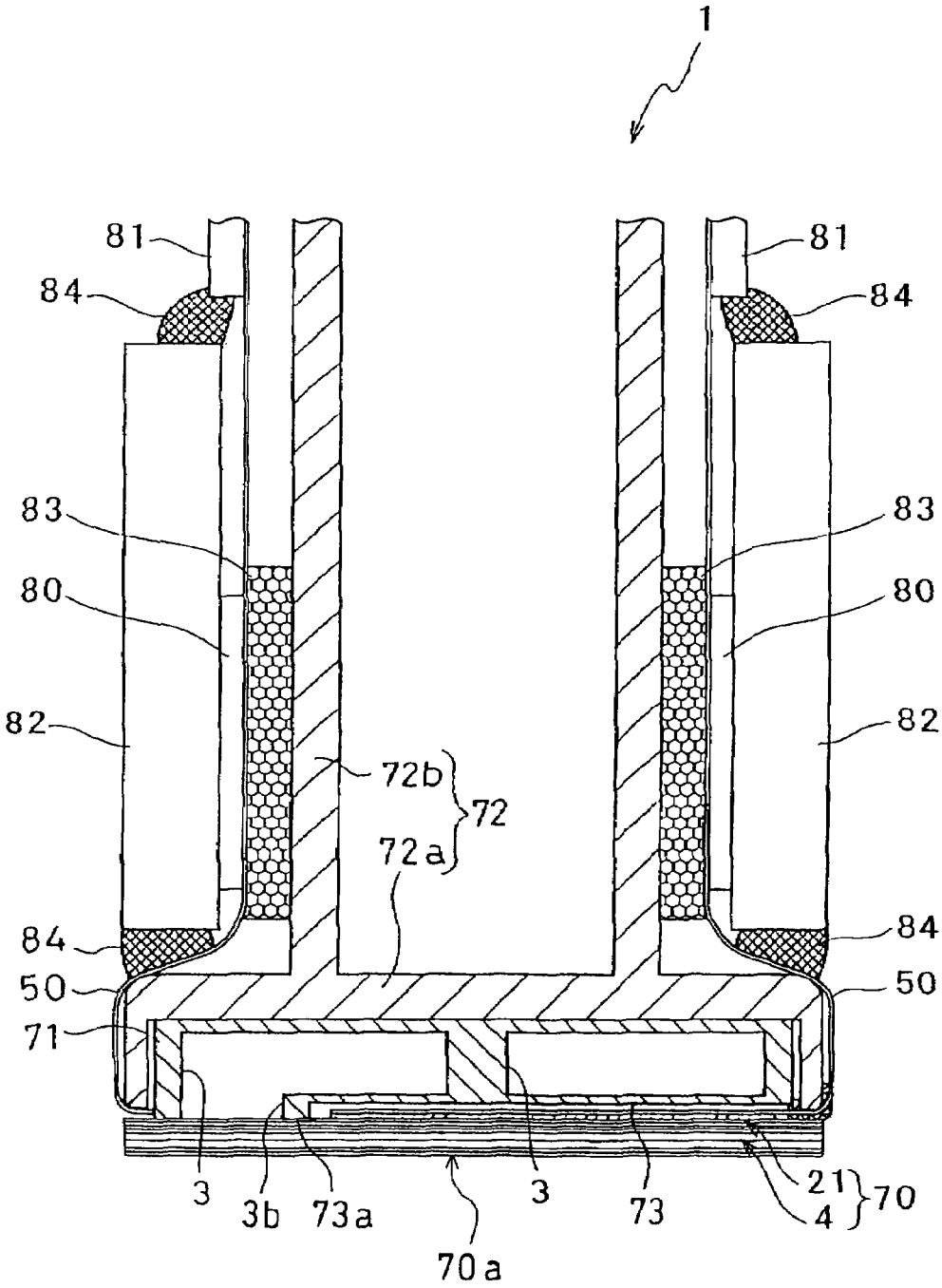
FIG. 2 is a cross-sectional view of the inkjet head shown in FIG. 1.

There will be described an inkjet head including a nozzle plate manufactured by a manufacturing method according to a first embodiment of the present invention. FIG. 1 is an external perspective view of an inkjet head to which a nozzle plate manufactured by the manufacturing method according to the first embodiment of the present invention is applied. FIG. 2 is a cross-sectional view taken along line II-II shown in FIG. 1. The inkjet head 1 has a head main body 70, a base block 71, and a holder 72. The head main body 70 ejects ink toward paper and has a rectangular plane shape extending in a main scanning direction. The base block 71 is disposed on an upper surface of the head main body 70 and serves as a reservoir unit in which are formed two ink reservoirs 3 to act as flow paths for the ink supplied to the head main body 70. The holder 72 holds the head main body 70 and the base block 71.

The head main body 70 includes a flow path unit 4 in which an ink flow path is formed, and a plurality of actuator units 21 bonded to the upper surface of the flow path unit 4 by means of an epoxy-based thermosetting adhesive. Each of the actuator unit 21 has a structure in which a plurality of thin plates are stacked one another and bonded together. The bottom surface of the head main body 70 forms an ink ejection surface 70*a* where a plurality of nozzles 8 (see FIG. 5), each having a minute diameter, are arranged. A flexible printed circuit board (FPC) serving as a power feeding member is soldered to the upper surface of the actuator unit 21 and pulled out rightward or leftward.

Figure 3:
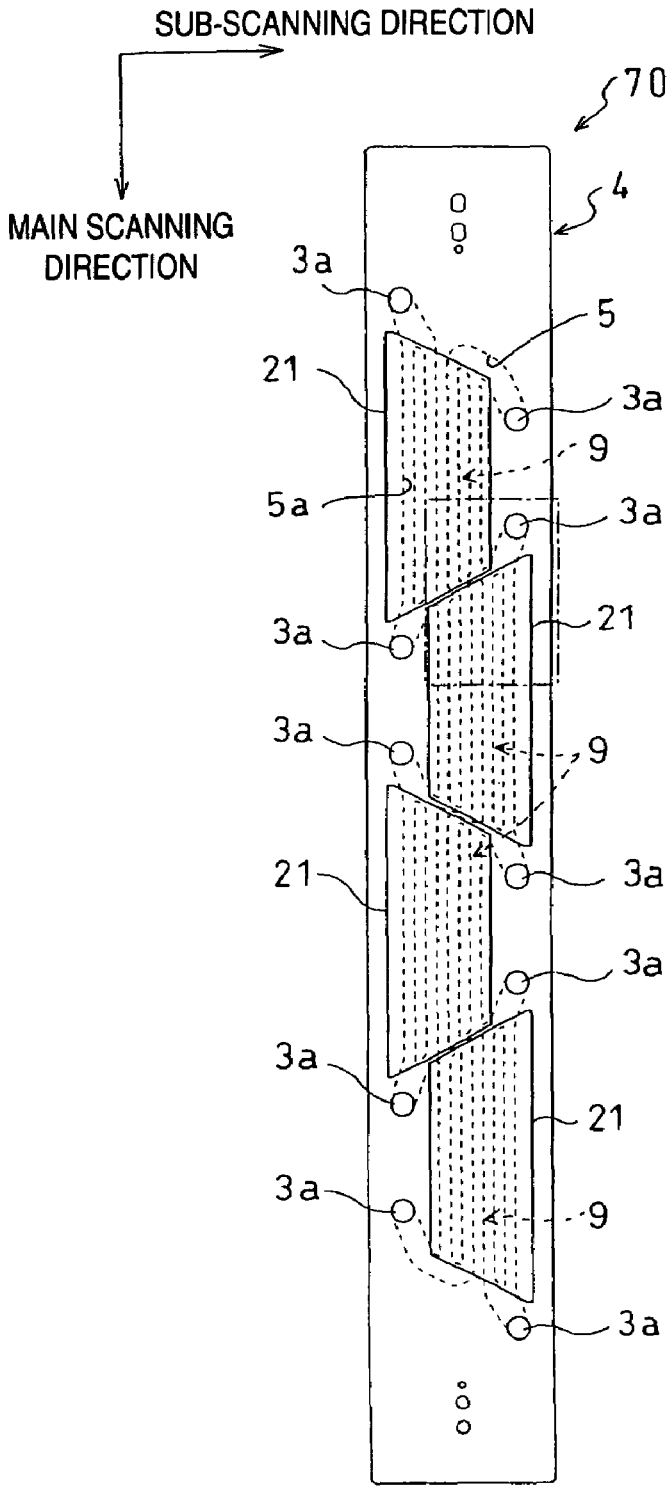
FIG. 3 is a plan view of a head main body included in the inkjet head shown in FIG. 1.

FIG. 3 is a plan view of the head main body 70 when viewed from above. As shown in FIG. 3, the flow path unit 4 has a rectangular plane shape extending in one direction (i.e., the main scanning direction). In FIG. 3, a manifold flow path 5, which serves as a common ink chamber provided within the flow path unit 4, is drawn in broken lines. The ink stored in the ink reservoir 3 of the base block 71 is supplied to the manifold flow path 5 by way of a plurality of openings 3*a*. The manifold flow path 5 is branched into a plurality of sub-manifold flow paths 5*a*, which extend in parallel to the longitudinal direction (i.e., the main scanning direction) of the flow path unit 4.

The four actuator units 21, each having a trapezoidal shape when viewed from above, are arranged in a staggered pattern of two rows so as to avoid the openings 3*a* and are bonded to the upper surface of the flow path unit 4. In each of the actuator units 21, parallel opposing sides (upper and lower sides) of thereof are arranged along with the longitudinal direction of the flow path unit 4. The plurality of openings 3*a* are arranged in two rows along with the longitudinal direction of the flow path unit 4. A total of ten openings 3*a*; that is, five openings for each row, are arranged at positions where the openings 3*a* do not interfere with the actuator units 21. Oblique sides of adjacent actuator units 21 partially overlap each other in a widthwise direction (a sub-scanning direction) of the flow path unit 4.

Areas of the lower surface of the flow path unit 4; that is, areas of the ink ejection surface 70*a*, which correspond to adhesion regions for the actuator unit 21, act as ink ejection regions where a plurality of nozzles 8 (see FIG. 6) are arranged in a matrix pattern. Pressure chamber groups 9, in each of which a plurality of pressure chambers 10 (see FIG. 5) are arranged in a matrix pattern, are formed in the areas of the upper surface of the flow path unit 4 facing the actuator units 21. Put another way, the actuator unit 21 has such a dimension as to extend over the plurality of pressure chambers 10 forming the pressure chamber group 9.

Turning back to FIG. 2, the base block 71 is made of metal material such as stainless steel. The ink reservoirs 3 in the base block 71 are hollow regions of essentially rectangular parallelepiped shape extending in the longitudinal direction of the base block 71. An opening (not shown) is formed in one end of the ink reservoir 3, and by way of the opening the ink reservoir 3 is supplied with ink from an ink tank (not shown) disposed outside and always filled with the ink. A total of ten openings 3*b* used for flowing out ink are provided in two rows in the ink reservoir 3 in the extended direction thereof and in a staggered pattern so as to be connected to the openings 3*a* of the flow path unit 4. Specifically, the ten openings 3*b* of the ink reservoir 3 and the ten openings 3*a* of the flow path unit 4 are arranged so as to have the same positional relationship.

A lower surface 73 of the base block 71 protrudes downward from a neighborhood area 73*a* of the opening 3*b*. The base block 71 remains in contact with the neighborhood areas of the openings 3*a* in the upper surface of the flow path unit 4 in only the neighborhood areas 73*a* of the openings 3*b* of the lower surface 73. Therefore, the areas of the lower surface 73 of the base block 71 except the neighborhoods 73*a* of the openings 3*b* are separated from the head main body 70, and the actuator units 21 are arranged in these separated areas.

The holder 72 includes a holding section 72*a* for holding the base block 71; and a set of projection sections 72*b* which are separated from each other in the sub-scanning direction and project upward from the upper surface of the holding section 72*a*. The base block 71 is fixedly bonded within a recessed portion formed in the lower surface of the holding section 72*a* of the holder 72. The FPCs 50 bonded to the actuator units 21 are respectively arranged so as to extend along the surfaces of the projection sections 72*b* of the holder 72 by way of an elastic member 83 such as a sponge. Driver ICs 80 are provided on the respective FPCs 50 placed on the surfaces of the projection sections 72*b* of the holder 72. Namely, the FPC 50 transmits a drive signal output from the driver IC 80 to the actuator units 21 of the head main body 70 and is electrically bonded to the actuator units 21 and the driver IC 80 by means of soldering.

A heat sink 82 of essentially—rectangular parallelepiped shape is hermetically provided on an exterior surface of each driver IC 80, and hence the heat having generated in the driver IC 80 can be efficiently radiated. A substrate 81 connected to the outside of the FPC 50 is provided at a position above the driver IC 80 and the heat sink 82. A space between the upper surface of the heat sink 82 and the substrate 81 and a space between the lower surface of the heat sink 82 and the FPC 50 are bonded by means of a sealing member 84, to thus prevent intrusion of dust or ink into the main body of the inkjet head 1.

Figure 4:
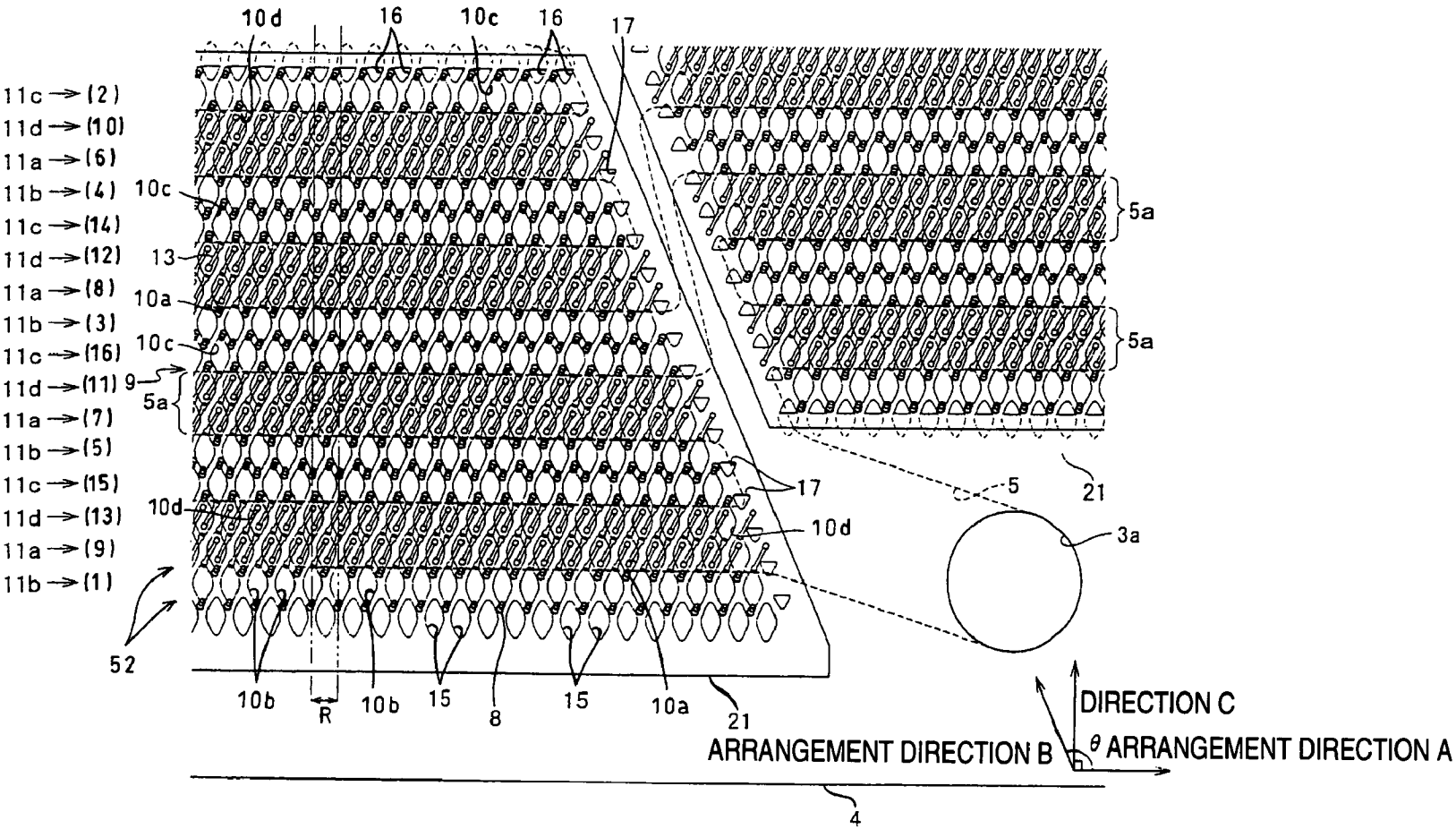
FIG. 4 is an enlarged view of an area enclosed by a dashed line shown in FIG. 3.
Figure 5:
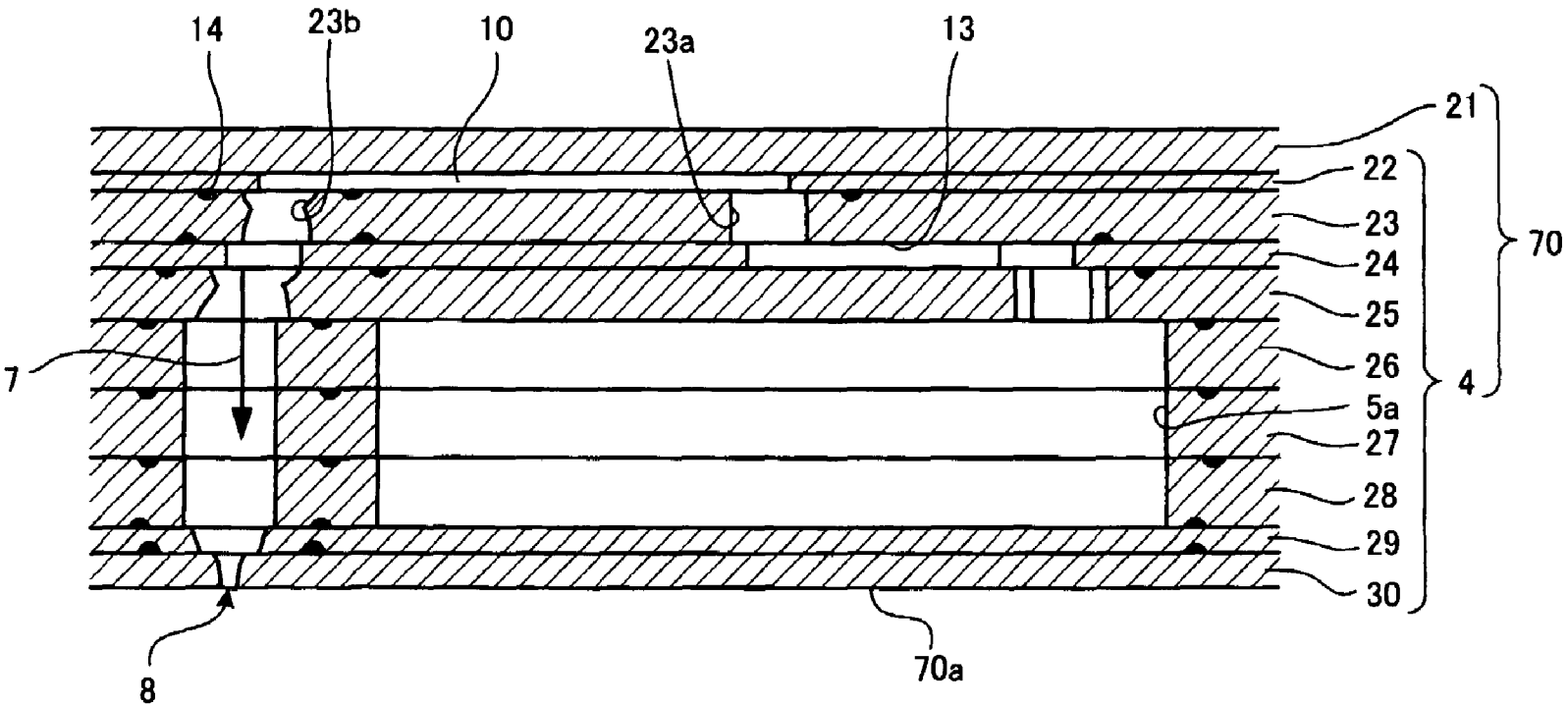
FIG. 5 is a fragmentary cross-sectional view corresponding to a pressure chamber of a head main body shown in FIG. 3.

FIG. 4 is an enlarged view of the area on the upper surface of the flow path unit 4, which is surrounded by a dashed line in FIG. 3. As shown in FIG. 4, four sub-manifold flow paths 5*a* extend in the area of the flow path unit 4 where an overlap exists between the actuator units 21, in parallel to the longitudinal direction of the flow path unit 4. A plurality of individual ink flow paths, which are in communication with the respective nozzles 8, are connected to the respective sub-manifold flow paths 5*a*. FIG. 5 is a cross-sectional view showing an individual ink flow path. As can be seen from FIG. 5, each of the nozzles 8 is in communication with the sub-manifold flow path 5*a* by way of the pressure chamber 10 and an aperture 13 (restrictor). Thus, an individual ink flow path 7 extending from the exit of the sub-manifold flow path 5*a* to the nozzle 8 by way of the aperture 13 and the pressure chamber 10 is formed in each pressure chamber 10 of the head main body 70.

<Cross-sectional Structure of the Head>

As can be seen from FIG. 5, the head main body 70 has a multilayer structure in which a total of ten sheet members are stacked; that is, in order from the top, the actuator unit 21, a cavity plate 22, a base plate 23, an aperture plate 24, a supply plate 25, manifold plates 26, 27, 28, a cover plate 29, and a nozzle plate 30. Of these sheet members, nine plates excluding the actuator unit 21 constitute the flow path unit 4.

As will be described later, the actuator unit 21 is formed by stacking four piezoelectric sheets 41 to 44 (see FIG. 9) and arranging electrodes therein, whereby only the uppermost layer of the stacked sheets is a layer having a portion, which becomes active during application of an electric field (hereinafter simply described as a mere "layer having an active portion"). The remaining three layers are non-active layers not having the active portion. The cavity plate 22 is a metal plate, wherein a plurality of essentially-rhombic holes constituting the airspace of the pressure chamber 10 are formed in areas on the cavity plate 22 where the actuator units 21 are affixed. The base plate 23 is a metal plate having a communication hole 23*a* and a communication hole 23*b*, in connection with one pressure chamber 10 of the cavity plate 22; namely, the communication hole 23*a* for connecting the pressure chamber 10 to the aperture 13, and the communication hole 23*b* connecting the pressure chamber 10 to the nozzle 8.

The aperture plate 24 is a metal plate having a hole serving as the aperture 13, and a communication hole for connecting the pressure chamber 10 to the nozzle 8, in connection with one pressure chamber of the cavity plate 22. The supply plate 25 is a metal plate having a communication hole for connecting the aperture 13 to the sub-manifold flow path 5*a*, and a communication hole for connecting the pressure chamber 10 to the nozzle 8, in connection with one pressure chamber 10 of the cavity plate 22. The manifold plates 26, 27, and 28 are metal plates, each plate having a communication hole for connecting the pressure chamber 10 to the nozzle 8 in addition to having the sub-manifold flow path 5*a*, in connection with one pressure chamber 10 of the cavity plate 22. The cover plate 29 is a metal plate having a communication hole for connecting the pressure chamber 10 to the nozzle 8, in connection with one pressure chamber 10 of the cavity plate 22. The nozzle plate 30 is a metal plate having the nozzle 8 in connection with one-pressure chamber 10 of the cavity plate 22.

The ten sheets 21 to 30 are stacked while being aligned with each other such that the individual ink flow path 7 is formed as shown in FIG. 5. This individual ink flow path 7 first goes upward from the sub-manifold flow path 5*a*, goes horizontally in the aperture 13, goes further upward and again extends horizontally in the pressure chamber 10, goes obliquely downward so as to depart from the aperture 13, and goes vertically downward toward the nozzle 8.

As is evident from FIG. 5, the pressure chamber 10 and the aperture 13 are provided at difference levels in a direction along which the plates are stacked. As shown in FIG. 4, the aperture 13 communicating with one pressure chamber 10 can be placed at the same position as another pressure chamber 10 adjacent to the pressure chamber of interest, when viewed from above. Consequently, the pressure chambers 10 are arranged at high density. Hence, printing of a higher-resolution image is realized by means of the inkjet head 1 having a comparatively small footprint.

Escape grooves 14 used for allowing excessive adhesive to flow thereinto are formed in the upper and lower surfaces of the base plate 23, the upper and lower surfaces of the manifold plate 28, the upper surface of the supply plate 25, the respective upper surfaces of the manifold plates 26, 27, and the lower surface of the cover plate 29 so as to surround the openings formed in bonded surfaces of the respective plates. The escape grooves 14 prevent occurrence of variations in the resistance of the flow path, which would otherwise be caused when an adhesive used for bonding plates squeezes into the individual ink flow path.

<Details of Nozzle Plate>

Figure 6:
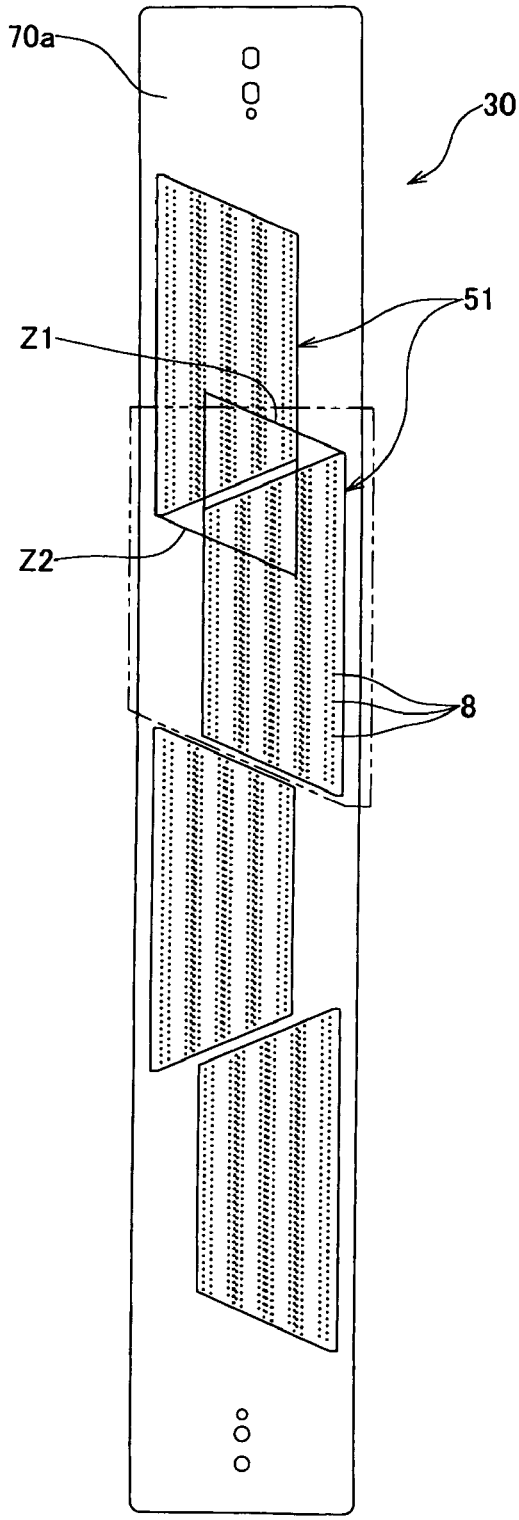
FIG. 6 is a plan view of a nozzle plate of a flow path unit shown in FIG. 5.

FIG. 6 is a plan view of the nozzle plate 30 of the flow path unit 4 shown in FIG. 5. As shown in FIG. 6, nozzle groups 51 are formed in ink ejection regions of the nozzle plate 30, which overlap the areas occupied by the actuator units 21 bonded to the upper surface of the flow path unit 4. Four nozzle groups 51 are formed so as to correspond to the four actuator units 21 and are arranged in two rows in the form of a staggered pattern. Specifically, each of the four nozzle groups 51 has a trapezoidal region, which is substantially identical with the two-dimensional geometry of the actuator unit 21. Parallel opposing sides of the trapezoidal geometry are arranged along with the longitudinal direction of the flow path unit 4. Oblique sides of adjacent nozzle groups 51 partially overlap each other in the widthwise direction of the flow path unit 4.

Figure 7:
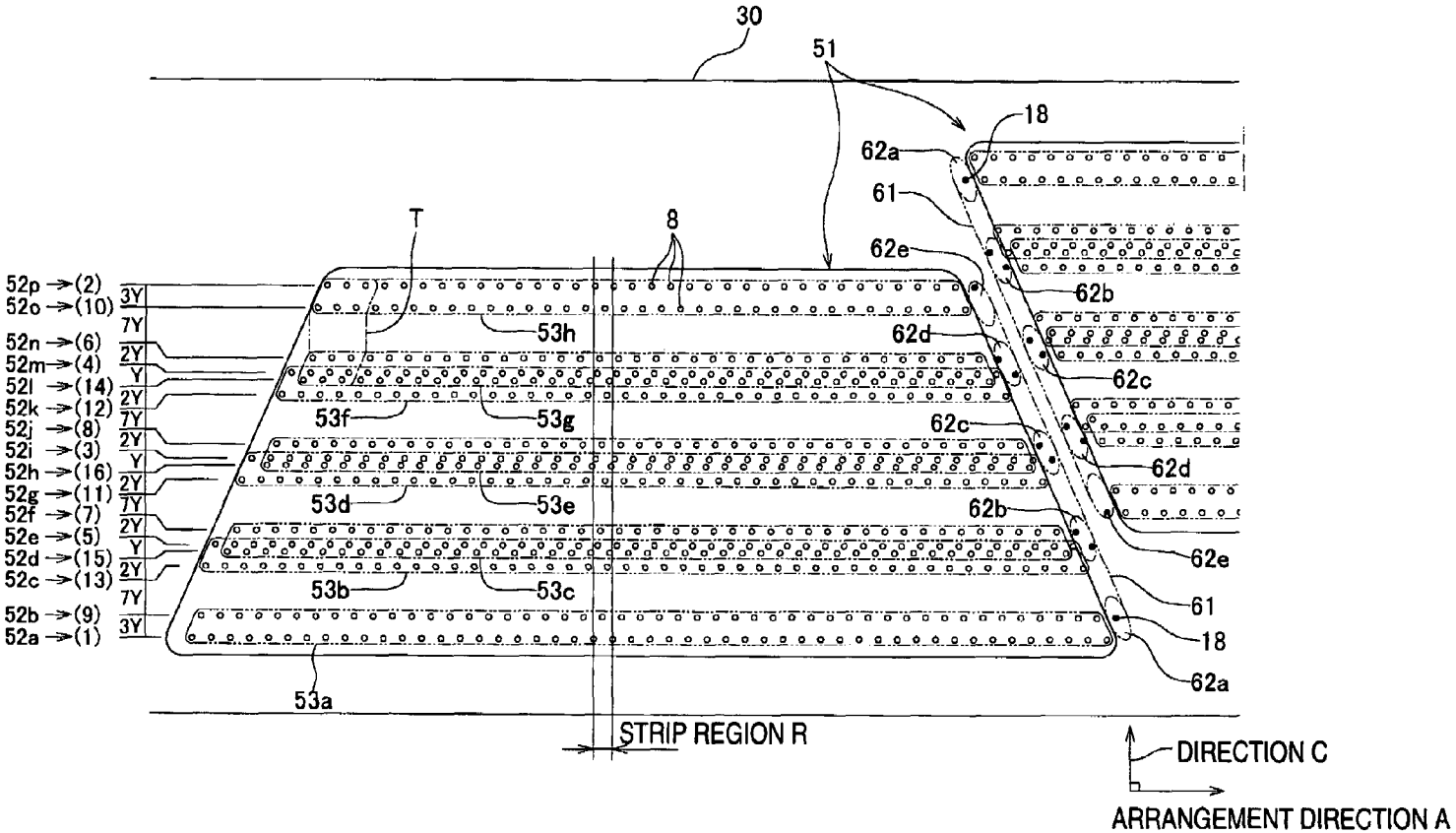
FIG. 7 is an enlarged plan view of an area enclosed by a chain double-dashed line shown in FIG. 6.

FIG. 7 is an enlarged plan view of the area surrounded by a chain double-dashed line shown in FIG. 6. As shown in FIG. 7, the nozzle group 51 comprises sixteen nozzle rows 52. The plurality of nozzles 8 are arranged in each nozzle row 52 along with an arrangement direction A. The sixteen nozzle rows 52 are arranged in parallel to each other, and the nozzles 8 forming each nozzle row 52 are spaced from each other by a distance corresponding to 37.5 dpi in the arrangement direction A. The arrangement direction A is identical with the longitudinal direction (the main scanning direction) of the inkjet head 1; that is, the direction in which the flow path unit 4 extends; and is in parallel to the previously-described main scanning direction.

The nozzle rows 52 are arranged at positions where the nozzle rows do not oppose the four sub-manifolds 5*a* (see FIG. 4). Of these nozzle rows 52, a nozzle row located along a longer side of one nozzle group 51 is taken as a first nozzle row 52*a*; and the other nozzle rows are sequentially assigned symbols toward a shorter side of the nozzle group 51 in the manner of a second nozzle row 52*b*, a third nozzle row 52*c*, . . . a $16^{th}$ nozzle row 52*p*. The nozzles 8 forming the first nozzle row 52*a* are provided in the highest number, and the nozzles 8 forming the $16^{th}$ nozzle row 52*p* are provided in the lowest number. In short, the number of nozzles forming the nozzle row 52 becomes smaller from the longer side of the nozzle group 51 toward the shorter side of the same, and the nozzle groups 51 remain within the ink ejection regions.

As shown in FIG. 7, the sixteen nozzle rows 52 are arranged such that the smallest interval exists between the fourth nozzle row 52*d* and the fifth nozzle row 52*e*, between the eight nozzle row 52*h* and the ninth nozzle row 52*i*, and between the twelfth nozzle row 521 and the thirteenth nozzle row 52*m*. Under the assumption that the smallest interval between the rows 52 is taken as Y, the largest interval existing between the second nozzle row 52*b* and the third nozzle row 52*c*, between the sixth nozzle row 52*f* and the seventh nozzle row 52*g*, between the tenth nozzle row 52*j* and the eleventh nozzle row 52*k*, and between the fourteenth nozzle row 52*n* and the fifteenth nozzle row 52*o* of the sixteen nozzle rows 52 is expressed as 7Y.

In the nozzle group 51, the sixteen nozzle rows 52 are divided into eight nozzle-row sets 53 by taking two nozzle rows 52 as a single set. The eight nozzle-row sets 53 are constituted of: a nozzle-row set 53*a* consisting of the first and second nozzle rows 52*a* and 52*b*; a nozzle-row set 53*b* consisting of the third and fifth nozzle rows 52*c* and 52*e*; a nozzle-row set 53*c* consisting of the fourth and sixth nozzle rows 52*d* and 52*f*; a nozzle-row set 53*d* consisting of the seventh and ninth nozzle rows 52*g* and 52*i*; a nozzle-row set 53*e* consisting of the eighth and tenth nozzle rows 52*h* and 52*j*; a nozzle-row set 53*f* consisting of the eleventh and thirteenth nozzle rows 52*k* and 52*m*; a nozzle-row set 53*g* consisting of the twelfth and fourteenth nozzle rows 521 and 52*n*; and a nozzle-row set 53*h* consisting of the fifteenth and sixteenth nozzle rows 52*o* and 52*p*. The distance between the nozzle rows 52 belonging to the respective eight nozzle-row sets 53 is uniform in a direction (direction C) orthogonal to the arrangement direction A, and the distance (a first predetermined distance) is set to 3Y.

FIG. 7 shows a strip region R, which has a width corresponding to 37.5 dpi (678.0 μm) in the arrangement direction A and extends in direction C. Single nozzles 8 of the respective nozzle rows 52 are present within this strip region R. Positions of these sixteen nozzles 8 projected on a straight line extending in the arrangement direction A are uniformly spaced apart from each other at an interval corresponding to 600 dpi, which is a resolution used for printing.

It is assumed that when the sixteen nozzles 8 belonging to a single strip region R are projected onto the straight line extending in the arrangement direction A, the sixteen nozzles 8 are assigned reference numerals (1) to (16) in sequence from a nozzle located leftmost on the straight line. In this case, the sixteen nozzles 8 are arranged, in sequence from below of the strip region R, (1), (9), (13), (15), (5), (7), (11), (16), (3), (8), (12), (14), (4), (6), (10), and (2). In the inkjet head 1 having such a configuration, when the actuator unit 21 is appropriately moved in conjunction with transport of a print medium, a letter and/or a drawing having a resolution of 600 dpi can be rendered.

When the sixteen nozzles 8 belonging to one strip region Rare projected on the straight line extending in the arrangement direction A, one nozzle 8 belonging to any of seven nozzle-row sets 53 is arranged between the two nozzles 8 belonging to the remaining one nozzle-row set 53, which exists in the strip region R. For example, in the nozzle-row set 53 consisting of the nozzle row 52*a* and the nozzle row 52*b*, two nozzles (1) and (9) existing in the strip region R come to the first and the ninth positions. Seven nozzles (2) to (8) corresponding to the second to the eighth are present between the first nozzle (1) and the ninth nozzle (9) and belong to the other seven nozzle-row sets 53, respectively. As mentioned above, in the two nozzle rows 52 of each nozzle-row set 53, the nozzles 8 belonging to one nozzle row 52 and the nozzles 8 belonging to the other nozzle row 52 are offset in the arrangement direction A. The offset distance (a second predetermined distance) corresponds to a distance over which the seven nozzles 8 of the other nozzle-row sets 53 are arranged at uniform intervals; that is, a distance (corresponding to 75 dpi) which is eight times the interval corresponding to 600 dpi. More specifically, all of the second predetermined distances of the eight nozzle-row sets 53 are equal to each other. These sixteen nozzle rows 52 are arranged to thus constitute the nozzle group 51.

Two regions 61 are defined between two adjacent nozzle groups 51 as shown in FIG. 7 such that each region 61 is present along each oblique side of each nozzle group 51. Five regions 62*a* to 62*e* are spaced from each other within each region 61 along with the one oblique side of the nozzle group 51. Dummy holes 16 (holes denoted as solid circles in FIG. 7) are formed within the regions 62 at a time when the nozzles 8 are formed in the nozzle plate 30. The dummy holes 18 are not in communication with the individual ink flow path 7. The dummy holes 18 are formed such that one dummy hole 18 is continuous with the plurality of nozzles 8 constituting the nozzle row 52 situated at a higher position in FIG. 7 among the two nozzle rows 52 of each nozzle-row set 53. Therefore, among the five regions 62, one dummy hole 18 is formed in each of the two regions 62*a* and 62*e*, which are situated at respective ends of one oblique side of the nozzle group 51. Two dummy holes 18 are formed in each of the three regions 62*b* to 62*d* other than the regions 62*a* and 62*e*. The dummy holes 18 pertaining to one nozzle group 51 are formed in a total number of eight. In the present embodiment, of the plurality of dummy holes 18, the eight dummy holes 18 continuous with the nozzles 8 of the nozzle rows 52 forming the left nozzle group 51 in FIG. 7 (i.e., the nozzle group 51 whose entirety is illustrated) are formed within a triangular zone Z1 (illustrated in FIG. 6), wherein the triangular zone Z1 is defined by subtracting the trapezoidal region of the nozzle group 51 from a parallelogram having the left oblique side and the longer side of the left nozzle group 51 in FIG. 7 as two sides. The eight dummy holes 18 continuous with the nozzles 8 of the nozzle rows 52 forming the right nozzle group 51 in FIG. 7 (i.e., the nozzle group 51 whose entirety is not illustrated) are formed within a triangular zone Z2 (illustrated in FIG. 6), wherein the triangular zone Z2 is defined by subtracting the trapezoidal region of the nozzle group 51 from a parallelogram having the right oblique side and the longer side of the right nozzle group 51 in FIG. 7 as two sides. Thus, the eight dummy holes 18 pertaining to one nozzle group 51 are formed within the triangular zones Z1, Z2 pertaining to the respective nozzle groups 51. Accordingly, the two regions 61 also fall within the triangular zones Z1, Z2. The regions 61 become smaller in area than the triangular zones Z1, Z2.

The right nozzle group 51 in FIG. 7 is arranged so as to direct an opposite direction to a direction to which the left nozzle group 51 directs. Hence, the dummy holes 18 formed in the vicinity of the oblique side of the right nozzle group 51 in FIG. 7 are made as if the plurality of dummy holes 18 formed in the vicinity of one oblique side of the left nozzle group 51 shown in FIG. 7 were inverted with respect to the horizontal direction. As shown in FIG. 7, the two regions 61 of the adjacent nozzle groups 51 are arranged so as to overlap in direction C. Hence, the oblique sides of the adjacent nozzle groups 51 can be made close to each other. Further, the two adjacent nozzle groups 51 are arranged to overlap in direction C. When all of the nozzles 8 belonging to the two nozzle groups 51 are projected on the straight line extending in the arrangement direction A, all projected points can be arranged at an interval corresponding to 600 dpi. As a result, even when the two adjacent nozzle groups 51 are separated from each other, an unbroken image can be formed. By means of the foregoing configuration, the adjacent nozzle groups 51 can be made close to each other in the lateral direction of the nozzle plate 30 (direction C) while being made close to each other in the longitudinal direction of the nozzle plate 30 (arrangement direction A). Thus, the longitudinal length and lateral length of the nozzle plate 30 can be reduced. In addition, the four actuator units 21 to be bonded to the flow path unit 4 can be arranged while maintaining the oblique sides of the adjacent actuator units 21 close to each other. Therefore, the two-dimensional geometry of the entire flow path unit 4 can be reduced, thereby making an attempt to miniaturize the inkjet head 1. A manufacturing method for forming the nozzles 8 and the dummy holes 18 in the nozzle plate 30 will be described later. As can be seen from the foregoing descriptions, the inkjet head 1 of the present embodiment is a so-called multi-line head having a plurality of nozzle rows 52 arranged in parallel. The structural characteristic of the multi-line head is that all of the nozzles 8 belonging to the plurality of nozzle rows 52 differ in position from each other in the direction of the nozzle rows. At the time of printing, control is performed so as to eject ink while sequentially positioning the nozzle rows 52 to face a straight line on a recording medium. Thereby, resolution in the direction of the nozzle rows is enhanced.

<Details of Entire Flow Path Unit>

Turning back to FIG. 4, a pressure chamber group 9 containing a plurality of pressure chambers 10 is formed within the area where the actuator unit 21 is affixed. The pressure chamber group 9 has a trapezoidal shape, which is of substantially the same size as the area where the actuator unit 21 is affixed. The pressure chamber group 9 is formed for each actuator unit 21.

As is evident from FIG. 4, each of the pressure chambers 10 belonging to the pressure chamber group 9 is in communication with the corresponding nozzle 8 at one end of a long diagonal line of the pressure chamber 10. The pressure chamber 10 is also in communication with the sub-manifold flow path 5*a* at the other end of the long diagonal line, by way of the aperture 13. As will be described later, individual electrodes 35 (see FIGS. 8 and 9), each having a substantially-rhombic two-dimensional geometry and being smaller than the pressure chamber 10 by one size, are arranged on the actuator unit 21 in a staggered manner so as to oppose the pressure chambers 10. In FIG. 4, in order to make the drawings easy to understand, the nozzle 8, the pressure chamber 10 and the aperture 13, which should be drawn in broken lines in the flow path unit 4, are rendered in solid lines.

The pressure chambers 10 are adjacently arranged in a staggered matrix pattern in two directions; that is, the arrangement direction A and the arrangement direction B. The shorter diagonal line of the pressure chamber 10 is in parallel to the previously-described arrangement direction A. The arrangement direction B is a direction of one oblique side of the pressure chamber 10, which forms an obtuse angle θ with the arrangement direction A. Both sharp-edged portions of the pressure chamber 10 are interposed between two other adjacent pressure chambers.

The pressure chambers 10 adjacently arranged in a matrix pattern in two directions; that is, the arrangement direction A and the arrangement direction B, are spaced apart from each other by a distance corresponding to 37.5 dpi along with the arrangement direction A. Sixteen pressure chambers 10 are arranged in the arrangement direction B within a single actuator unit 21.

The plurality of pressure chambers 10 arranged in a matrix pattern form a plurality of pressure chamber rows 11 along with the arrangement direction A shown in FIG. 4. When viewed in a direction perpendicular to the paper plane of FIG. 4, the pressure chamber rows 11 are divided into a first pressure chamber row 11*a*, a second pressure chamber row 11*b*, a third pressure chamber row 11*c*, and a fourth pressure chamber row 1*d* in accordance with the relative positions to the sub-manifold flow paths Sa. The first through fourth pressure chamber rows 11*a* to 11*d* are cyclically disposed from the upper side of the actuator unit 21 to the lower side of the same in sequence of 11*c*→11*d*→11*a*→11*b*→11*c*→11*d*→. . . →11*b*.

When viewed from the direction perpendicular to the paper plane of FIG. 4, the nozzles 8 are deviated in the direction C to the lower side of the paper plane of FIG. 4 in the pressure chambers 10*a* forming the first pressure chamber row 11*a* and the pressure chambers 10*b* forming the second pressure chamber row 11*b*. The nozzles 8 oppose the neighborhoods of the lower end portions of the corresponding pressure chambers 10. Meanwhile, the nozzles 8 are deviated in the direction C to the upper side of the paper plane of FIG. 4 in the pressure chambers 10*c* forming the third pressure chamber row 11*c* and the pressure chambers 10*d* forming the fourth pressure chamber row 11*d*. The nozzles 8 face the neighborhoods of the upper end portions of the corresponding pressure chambers 10. In the first and fourth pressure chamber rows 11*a* and 11*d*, half or more the areas of the pressure chambers 10*a* and 10*b* overlap the sub-manifold flow paths 5*a* when viewed from the paper plane of FIG. 4. In the second and third pressure chamber rows 11*b* and 11*c*, substantially the entire regions of the pressure chambers 10*b* and 10*c* do not overlap the sub-manifold flow paths 5*a* when viewed from the direction perpendicular to the paper plane of FIG. 4. Therefore, smooth supply of ink to the respective pressure chambers 10 belonging to any of the pressure chamber rows 11 becomes possible by broadening the width of the sub-manifold flow paths 5*a* as much as possible such that the nozzles 8 remaining in communication with the pressure chambers 10 do not overlap the sub-manifold flow paths 5*a*.

As shown in FIG. 4, a plurality of peripheral voids 15, each being identical in shape and size with the pressure chamber 10, are formed in the head main body 70 in the form of a straight line along and across a longer one of the set of parallel sides of the trapezoidal pressure chamber group 9. The peripheral voids 15 are defined by closing holes—which are formed in the cavity plate 22 and are identical in shape and size with the pressure chambers 10—with the actuator unit 21 and the base plate 23. Specifically, the ink flow paths are not connected to the peripheral voids 15, and opposing individual electrodes 35 are not provided for the peripheral voids 15; namely, the peripheral voids 15 are not filled with ink.

A plurality of peripheral voids 16 are arranged in the head main body 70 in the form of a straight line along and across the shorter side of the set of parallel sides of the trapezoidal pressure chamber group 9. Moreover, a plurality of peripheral voids 17 are arranged in the head main body 70 in the form of a straight line along and across both oblique sides of the trapezoidal pressure chamber group 9. The peripheral voids 16, 17 penetrate through the cavity plate 22 within an equilateral triangular area when viewed from above. Ink flow paths are not connected to the peripheral voids 16, 17, and opposing individual electrodes 35 are not provided for the peripheral voids 16, 17. In short, as in the case of the peripheral voids 15, the peripheral voids 16, 17 are not filled with ink.

<Details of Actuator Unit>

Next will be described the structure of the actuator unit 21. The plurality of individual electrodes 35 are arranged on the actuator unit 21 into a matrix with the same pattern in which the pressure chambers 10 are arranged. The individual electrodes 35 are arranged at positions facing the pressure chambers 10 when viewed from above.

Figure 8:
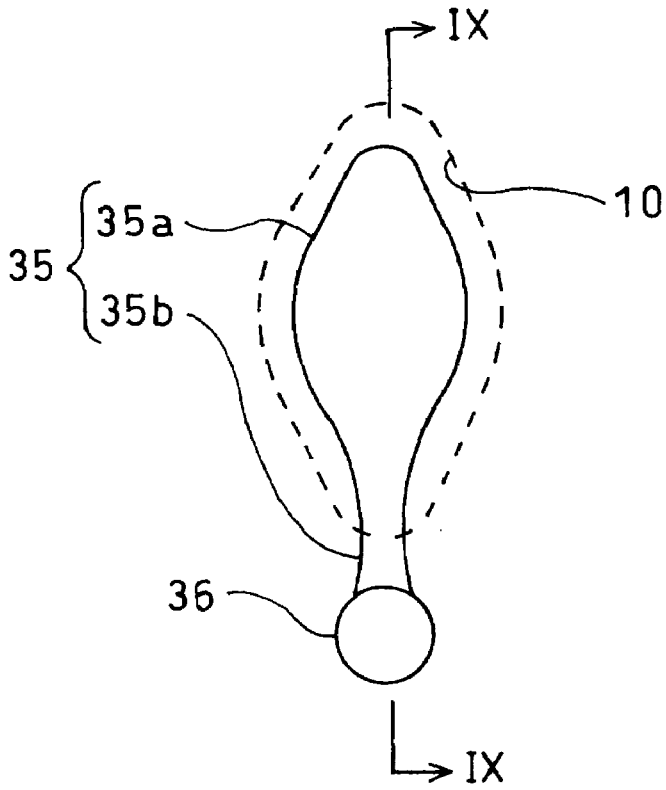
FIG. 8 is a plan view of a individual electrode fabricated on an actuator unit shown in FIG. 3.

FIG. 8 is a plan view of the individual electrode 35. As shown in FIG. 8, the individual electrode 35 is formed from a main electrode region 35*a*, which is placed at a position facing the pressure chamber 10 and is housed in the pressure chamber 10 when viewed from above; and an auxiliary electrode region 35*b*, which is connected to the main electrode region 35*a* and placed at a position facing the outside of the pressure chamber 10.

Figure 9:
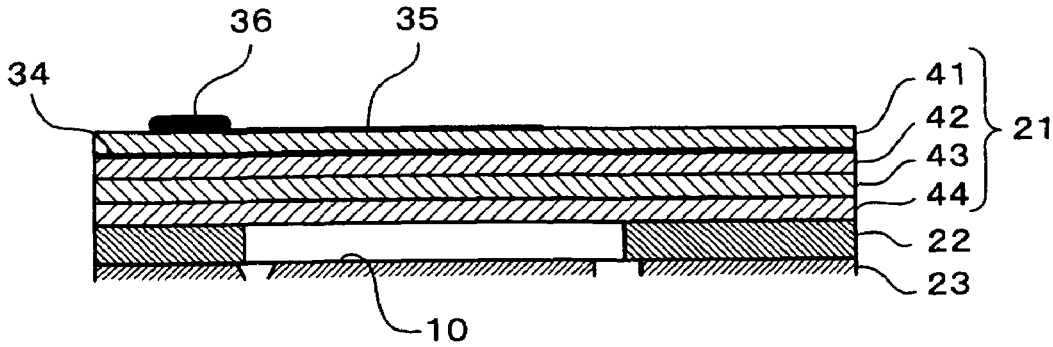
FIG. 9 is a fragmentary cross-sectional view of the actuator unit shown in FIG. 3.

FIG. 9 is a cross-sectional view taken along line 1X-1X shown in FIG. 8. As shown in FIG. 9, the actuator unit 21 includes the four piezoelectric plates 41, 42, 43, and 44 which have the same thickness; that is, 15 μm or thereabouts. The piezoelectric plates 41 to 44 are formed into a layered flat plate (a continuous flat plate layer) arranged so as to straddle a large number of pressure chambers 10 formed within one ink ejection region of the head main body 70. As a result of the piezoelectric plates 41 to 44 being arranged as a continuous flat plate layer so as to straddle the large number of pressure chambers 10, the individual electrodes 35 can be arranged at high density on the piezoelectric plate 41 through use of, e.g., the screen printing technique. Therefore, the pressure chambers 10 formed in positions corresponding to the individual electrodes 35 can also be arranged at high density, so that a high-resolution image can be printed. The piezoelectric plates 41 to 44 are made of lead-zicronate-titanate-(PZT)-based ceramic material exhibiting ferroelectricity.

As shown in FIG. 8, the main electrode region 35*a* of the individual electrode 35 formed on the piezoelectric plate 41 of the uppermost layer assumes an essentially rhombic two-dimensional geometry which is approximately analogous to the shape of the pressure chamber 10. A lower sharp-edge portion of the essentially-rhombic main electrode region 35*a* is extended and connected to the auxiliary electrode region 35*b* facing the outside of the pressure chamber 10. A circular land portion 36 electrically connected to the individual electrode 35 is provided at the extremity of the auxiliary electrode region 35*b*. As shown in FIG. 9, the land portion 36 faces a region of the cavity plate 22 where no pressure chamber 10 is formed. The land portion 36 is made from gold containing glass frit, and is bonded to the surface of an extended portion of the auxiliary electrode region 35*b*, as shown in FIG. 8. The FPC 50 is omitted from FIG. 9, but the land portion 36 is electrically bonded to a contact point provided on the FPC 50. At the time of bonding, the contact point of the FPC 50 must be pressed against the land portion 36. Since the pressure chamber 10 is not formed in the area of the cavity plate 22 facing the land portion 36, bonding can be performed reliably by means of sufficient pressing.

A common electrode 34, which has the same outer shape as that of the piezoelectric plate 41 and has a thickness of about 2 μm, is interposed between the piezoelectric plate 41 of the uppermost layer and the lower piezoelectric plate 42. The individual electrode 35 and the common electrode 34 are made of metal material such as an Ag-Pd-based material.

The common electrode 34 is connected to a ground within an unillustrated region. Thereby, the common electrode 34 is held at a uniform and predetermined electric potential in the area corresponding to all of the pressure chambers 10; that is, at a ground potential in the present embodiment. The individual electrode 35 is connected to the driver IC 80 by way of the FPC 50 including other independent lead wires assigned to the respective individual electrodes 35 and the land portion 36 so that the electric potentials of the individual electrodes 35 corresponding to the respective pressure chambers 10 can be controlled.

<Method for Driving Actuator Unit>

A method for driving the actuator unit 21 will now be described. A polarizing direction of the piezoelectric plate 41 in the actuator unit 21 is its thickness wise direction. Specifically, the actuator unit 21 has a so-called unimorph configuration, wherein the upper single piezoelectric plate 41 (distant from the pressure chamber 10) is taken as a layer where the active portion exists, and three lower piezoelectric plates 42 to 44 (close to the pressure chamber 10) are taken as the non-active layers. Accordingly, when the individual electrode 35 is brought into a predetermined positive or negative potential, an electric field application area of the piezoelectric plate 41 sandwiched between the electrodes acts as the active portion (a pressure generation section). For instance, when the electric field and polarization are aligned in the same direction, the actuator unit 21 contracts in a direction perpendicular to the polarizing direction by means of the piezoelectric transversal effect.

In the present embodiment, the area of the piezoelectric plate 41 sandwiched between the main electrode region 35*a* and the common electrode 34 acts as the active portion which causes distortion by means of the piezoelectric effect when subjected to an applied electric field. Meanwhile, no electric field is applied from the outside to the three piezoelectric plates 42 to 44 located below the piezoelectric plate 41, and hence the plates 42 to 44 substantially do not act as the active portion. Therefore, the area of the piezoelectric plate 41 sandwiched between primarily the main electrode region 35*a* and the common electrode 34 contracts in the direction perpendicular to the polarizing direction by means of the piezoelectric transversal effect.

The piezoelectric plates 42 to 44 are not susceptible to the influence of the electric field, and hence do not cause displacement spontaneously. For this reason, a difference arises between the upper piezoelectric plate 41 and the lower piezoelectric plates 42 to 44 in terms of distortion in the direction perpendicular to the polarizing direction, and hence the overall piezoelectric plates 41 to 44 are about to deform so as to become protrusive toward the non-active side (unimorph deformation). At this time, as shown in FIG. 9, since the lower surface of the actuator unit 21 constituted by the piezoelectric sheets 41 to 44 is fixed to the upper surface of a partition wall (the cavity plate) 22 defining the pressure chamber 10, the piezoelectric sheet 41 to 44 deform to protrude toward the pressure chamber side. Accordingly, the volume of the pressure chamber 10 is decreased, and the pressure of ink is increased, whereupon ink is ejected from the nozzle 8. Subsequently, when the individual electrode 35 is brought back into the same electric potential as that of the common electrode 34, the piezoelectric plates 41 to 44 returns to their original shapes, and the volume of the pressure chamber 10 returns to the original volume, whereby ink is sucked from the sub-manifold flow path 5*a*.

According to another driving method, the individual electrode 35 is held at an electric potential different from that of the common electrode 34. Every time an ejection request is issued, the individual electrode 35 can be temporarily brought to the same potential as that of the common electrode 34 and again brought to the electric potential different from that of the common electrode 34 at a predetermined timing. In this case, the piezoelectric plates 41 to 44 restore their original shapes at the timing at which the individual electrode 35 is brought into the same electric potential as that of the common electrode 34. Thereby, when compared with the volume of the pressure chamber 10 in the initial state (a state in which the electrodes are at different electric potentials), that volume is increased, and ink is sucked into the pressure chamber 10 from the sub-manifold flow path 5*a*. Subsequently, the piezoelectric plates 41 to 44 are deformed so as to protrude toward the pressure chamber 10 at the timing at which the individual electrode 35 is brought to the electric potential different from that of the common electrode 34, whereupon the pressure of ink is increased as a result of a drop in the volume of the pressure chamber 10, to thus eject ink.

<Example Operation During Printing>

Turning back to FIG. 4, the strip region R shown in FIG. 4 is the same as the strip region R shown in FIG. 7. In this strip region R, only one nozzle 8 is present in each of the sixteen pressure chamber rows 11*a* to 11*d*. As a result, the pressure chamber rows 11*a* to 11*d* are understood to correspond sequentially, in order from the bottom, to the first nozzle row 52*a* to the sixteenth nozzle row 52*p* shown in FIG. 7.

For instance, there is described a case where a straight line extending in the arrangement direction A is printed at a resolution of 600 dpi. First, a brief description is given to a reference example where the nozzles 8 are in communication with the sharp-edged portion of the pressure chamber 10 that is on the same side as the nozzles 8. In this case, ejection of ink from the nozzles 8 in the pressure chamber row situated at the lowest position in FIG. 4 is initiated, and ink is ejected by sequentially selecting an upper adjacent nozzles B belonging to a next upper adjacent pressure chamber row, in association with transport of paper. As a result, ink dots are formed in the arrangement direction A while adjoining each other at an interval of 600 dpi. Finally, a straight line extending in the arrangement direction A is wholly drawn at a resolution of 600 dpi.

In the present embodiment, the nozzles 8 in the pressure chamber row 11 situated in the lowermost position in FIG. 4 start ejecting ink, and ink is ejected by sequentially selecting the nozzles 8 belonging to a next upper adjacent pressure chamber, in association with transport of paper. At this time, the deviation of the nozzle position in the arrangement direction A changes from one pressure chamber row to the next. For this reason, the ink dots sequentially formed in the arrangement direction A in association with transport of paper are not arranged at a uniform interval of 600 dpi.

As shown in FIG. 4, in association with transport of the print medium, ink is ejected from the nozzle (1) in communication with the pressure chamber row 11*b* situated in the lowermost position in the drawing, whereupon rows of dots are formed on the print medium at an interval corresponding to 37.5 dpi. Subsequently, when the position where the straight line is to be formed has reached the position of the nozzle (9) in communication with the pressure chamber row 11*a*, which is the second row from the bottom in association with transport of the print medium, ink is ejected from the nozzle (9). As a result, second ink dots are formed in a position, which is deviated in the arrangement direction A from the position of the dots formed first by a distance that is eight times the interval corresponding to 600 dpi.

Next, when the position where the straight line is to be formed has been reached, in association with transport of the print medium, the position of the nozzle (13) in communication with the pressure chamber row 11*d*, which is the third row from the bottom, ink is ejected from the nozzle (13). Thereby, third ink dots are formed in a position, which is deviated in the arrangement direction A from the position of the dots formed first by a distance that is twelve times the interval corresponding to 600 dpi. When the position where the straight line is to be formed has been reached, in association with transport of the print medium, the position of the nozzle (15) in communication with the pressure chamber row 11*c*, which is the fourth row from the bottom, ink is ejected from the nozzle (15). Thereby, fourth ink dots are formed in a position, which is deviated in the arrangement direction A from the position of the dots formed first by a distance that is fourteen times the interval corresponding to 600 dpi. When the position where the straight line is to be formed has been reached, in association with transport of the print medium, the position of the nozzle (5) in communication with the pressure chamber row 11*b*, which is the fifth row from the bottom, ink is ejected from the nozzle (5). Thereby, fifth ink dots are formed in a position which is deviated in the arrangement direction A from the position of the dots formed first by a distance that is four times the interval corresponding to 600 dpi.

Similarly, ink dots are formed by sequentially selecting the nozzles 8 in communication with the pressure chamber 10 situated in the next higher position. At this time, when the number of nozzles 8 shown in FIG. 4 is taken as N, ink dots are formed in a position that is deviated in the arrangement direction A from the position where the dots are formed first by a distance corresponding to (a scaling factor "n"=N−1)× (an interval corresponding to 600 dpi). When the sixteen nozzles 8 have finally been selected, the ink dots formed at the interval corresponding to 37.5 dpi by means of the nozzle (1) in the pressure chamber row 11*b* in the bottom row in the drawing are joined together by means of fifteen dots formed at the interval corresponding to 600 dpi. The straight line extending in the arrangement direction A can be wholly drawn at a resolution of 600 dpi.

A complementary relationship exists between the neighborhood of respective ends of each nozzle group S1 (i.e., the oblique sides of the actuator unit 21) in the arrangement direction A and the neighborhood of respective ends of the nozzle group 51 corresponding to another opposing actuator unit 21 in the widthwise direction of the head main body 70, whereby printing can be performed at a resolution of 600 dpi. As a result, an image recorded by the ink ejected from the four nozzle groups 51 can be formed without interruption.

<Method for Manufacturing Inkjet Head>

Figure 10:
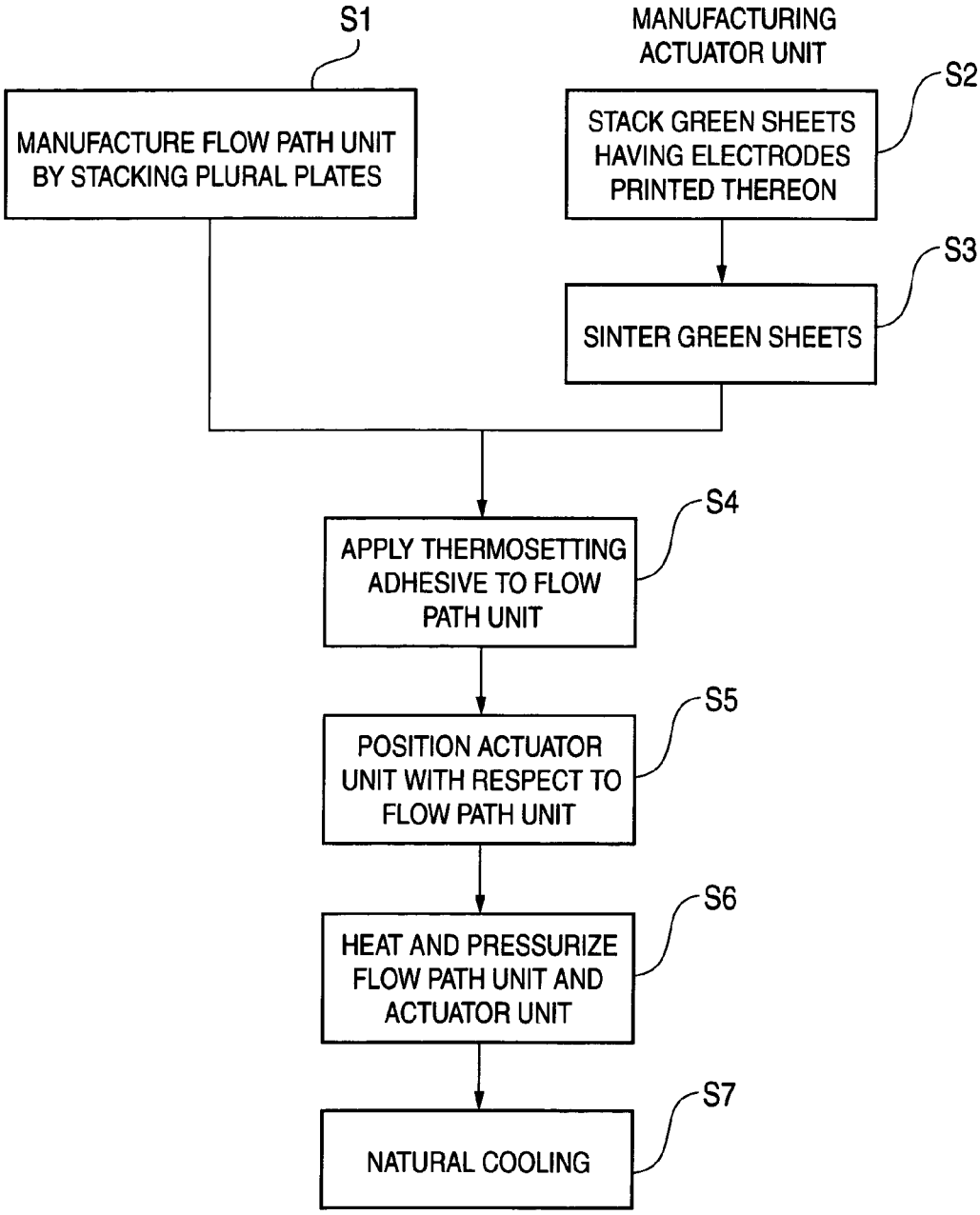
FIG. 10 is a view of processes for manufacturing an inkjet head according to the first embodiment of the present invention.

There will now be described a method for manufacturing the previously-described inkjet head 1 with reference to FIG. 10. FIG. 10 is a view showing processes for manufacturing the inkjet head 1.

In order to manufacture the inkjet head 1, components such as the flow path unit 4 and the actuator unit 21 are manufactured separately and then, the components are assembled. First, in step 1 (S1), the flow path unit 4 is manufactured. In order to manufacture the flow path unit 4, plates 22 to 29 excluding the nozzle plate 30 among the plates 22 to 30 constituting the flow path unit 4 are etched while a patterned photoresist is used as a mask, thereby forming the holes, such as those shown in FIG. 5, in the respective plates 22 to 29. As will be described later, after the plurality of nozzles 8 and the dummy holes 18 have been formed by punches 91, the nine plates 22 to 30—which are positioned such that the individual ink flow paths 7 byway of which the respective pressure chambers 10 are in communication with the respective nozzles 8 are formed—are stacked by way of an epoxy-based thermosetting adhesive. The nine plates 22 to 30 are heated to a temperature at which the thermosetting adhesive is cured, or higher, while being pressurized. Thereby, the thermosetting adhesive becomes cured, so that the nine plates 22 to 30 are fixedly bonded together. Thus, the flow path unit 4, such as that shown in FIG. 5, is obtained.

In order to manufacture the actuator unit 21, a plurality of green sheets of piezoelectric ceramic are prepared in step 2

(S2). The green sheets are formed beforehand with considering expectation of the degree of contraction stemming from sintering. A conductive paste is provided on some of the green sheets in the pattern of the common electrode 34 through screen printing. The green sheets—an which the conductive paste has been printed in the pattern of the common electrode 34—are stacked below the green sheets on which the conductive paste is not printed while the green sheets are aligned to each other through use of a jig. Two green sheets on which no conductive paste is printed are further stacked below the thus-aligned green sheets.

In step 3 (S3), the laminated product obtained in step 2 is subjected to degreasing as is known ceramic, and is sintered at a predetermined temperature. Thereby, the four green sheets turn into the piezoelectric plates 41 to 44, and the conductive paste becomes the common electrode 34. Subsequently, a conductive paste is provided on the piezoelectric plate 41 of the uppermost layer in the pattern of the individual electrode 34 through screen printing. In due course, gold containing glass frit is printed on the individual electrode 35, to thus form a land portion 36. In this way, the actuator unit 21 such as that shown in FIG. 9 can be manufactured.

As a modification, an actuator unit in which neither the individual electrode 35 nor the land portion 36 is formed (for the sake of convenience, an actuator unit of this type is sometimes called herein an "actuator unit") and the flow path unit 4 may be bonded by means of heating. Then, a conductive paste may be provided on the actuator unit in the pattern of the individual electrode 35 through screen printing, and may be further subjected to heating. Alternatively, a green sheet—on which a conductive paste is provided in the pattern of the individual electrode 35 through screen printing—may be prepared, and another green sheet—n which are provided a conductive paste in the pattern of the individual electrode 34 through screen printing—may be stacked below the green sheet. In addition, two green sheets on which is printed a conductive paste may also be stacked further below the thus-stacked green sheets, to thus form a laminated product. This laminated product may be subjected to heat treatment.

A process for forming a flow path unit pertaining to step 1 and processes for forming an actuator unit pertaining to steps 2 and 3 are performed independently of each other. Therefore, either step 1 or steps 2 and 3 may be performed first, or step 1 may be performed concurrently with steps 2 and 3.

Next, in step 4 (S4), by means of a bar coater, an epoxy-based thermosetting adhesive whose thermosetting temperature is 80° C. or thereabouts is applied over a surface which is obtained in step 1 and in which a plurality of indentations corresponding to the pressure chambers of the flow path unit 4 are formed. For instance, a thermosetting adhesive of two-liquid mixed type is used as the thermosetting adhesive subsequently, in step 5, the actuator units 21 are placed on the thermosetting adhesive layer applied over the flow path unit 4. At this time, the respective actuator units 21 are positioned with respect to the flow path unit 4 such that the active portion opposes the pressure chambers 10. Positioning of the actuator units 21 is performed on the basis of positioning marks (not shown) previously formed on the flow path unit 4 and the actuator units 21 through production steps (step 1 to step 3).

Next, in step 6 (S6), a multilayered product consisting of the flow path unit 4, the thermosetting adhesive existing between the flow path unit 4 and the actuator units 21 is pressurized while being heated to a temperature which is higher than the thermosetting temperature of the thermosetting adhesive, by means of an unillustrated heating-and-pressurizing apparatus. In step 7 (S7), the multilayered product having exited the heating-and-pressurizing apparatus is self-cooled. Thus, the head main body 70 formed from the flow path unit 4 and the actuator units 21 is manufactured.

Subsequently, after processing pertaining to the step of bonding the FPC 50 has been completed, the previously-described inkjet head 1 is completed by way of the process for bonding the base block 71.

<Method for Manufacturing a Nozzle Plate>

Figure 11:
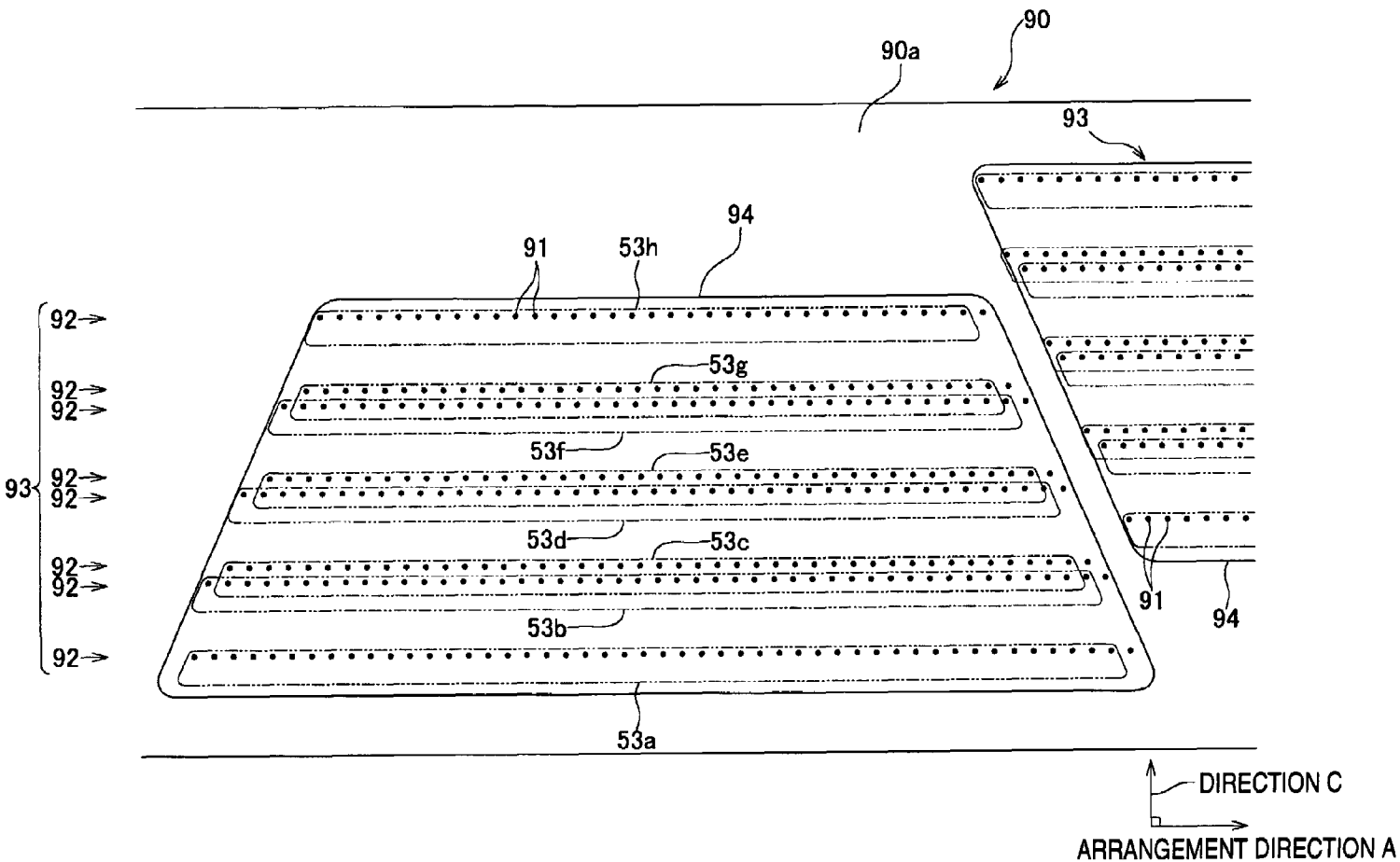
FIG. 11 is a plan view of a part of a mold employed in the manufacturing method according to the first embodiment of the present invention.
Figure 12:
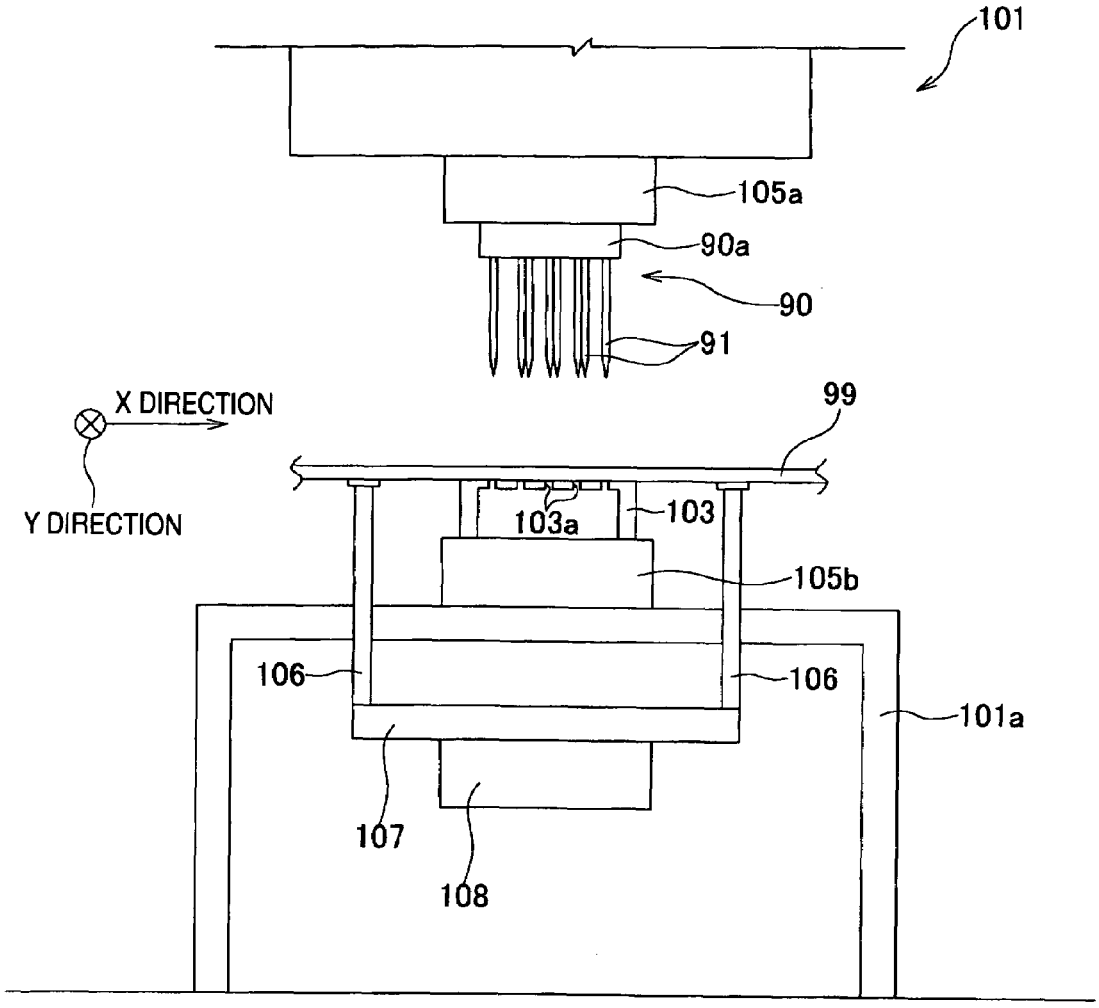
FIG. 12 is a schematic block diagram of a pressing machine used in the manufacturing method according to the first embodiment of the present invention.
Figure 13:
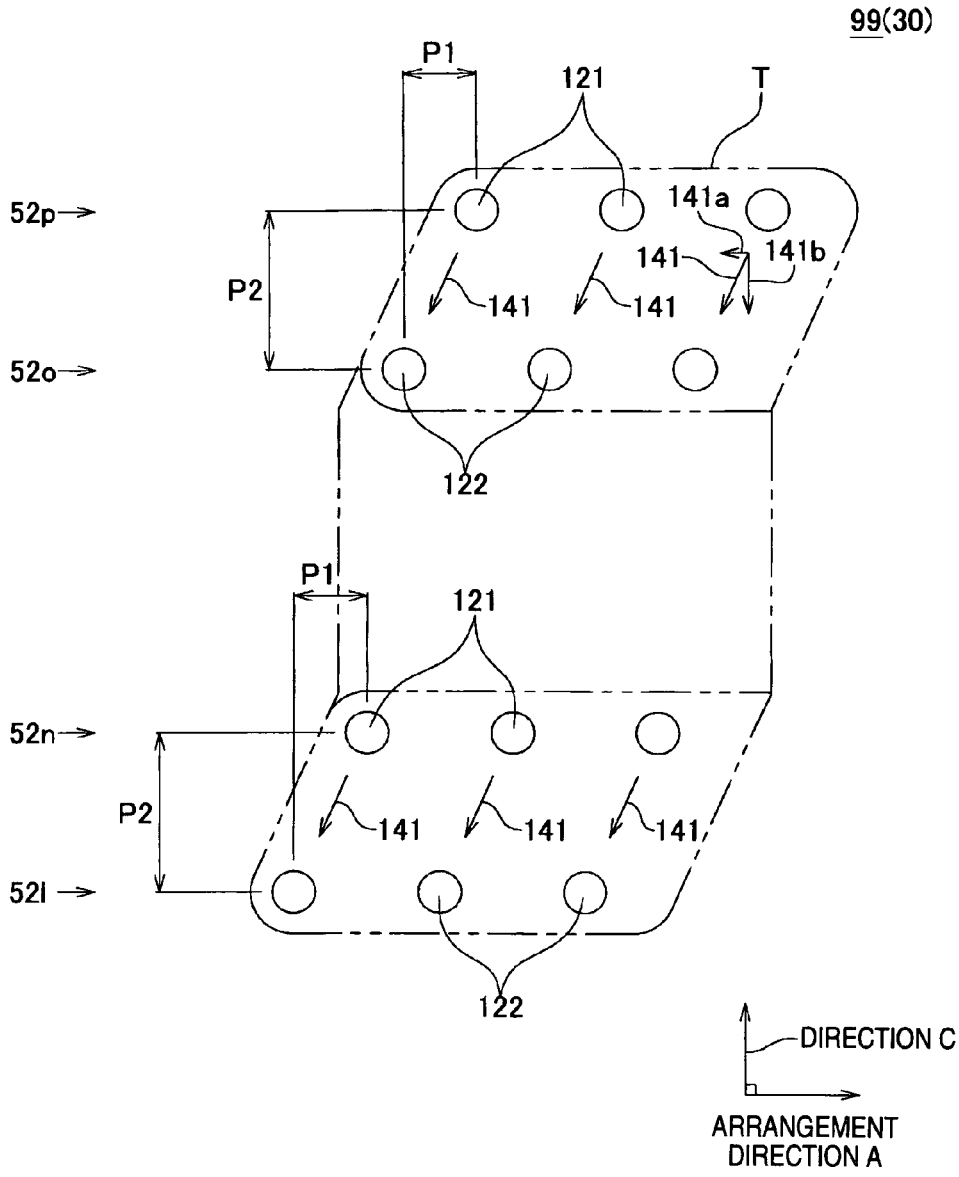
FIG. 13 is a descriptive view showing processes for forming nozzles to be formed in the nozzle plate of the inkjet head according to the first embodiment of the present invention.

Next, details of a method for manufacturing a nozzle plate 30 forming a part of the previously-described flow path unit 4 will be described hereunder. FIG. 11 is a plan view of a portion of a mold employed in the manufacturing method according to the first embodiment of the present invention. FIG. 12 is a schematic block diagram of a pressing machine used in the manufacturing method according to the first embodiment of the present invention. FIG. 13 is a descriptive view showing processes for forming nozzles to be formed in the nozzle plate 30 of the inkjet head according to the first embodiment of the present invention; that is, an enlarged view of the region T shown in FIG. 7.

As shown in FIG. 11, a mold 90 has a main body 90*a* having a rectangular plane shape analogous to that of the ink ejection surface 70*a* of the head main body 70, and a plurality of punches 91 (see FIG. 12), which protrude from the main body 90*a* and have pointed extremities. The mold 90 has punch rows 92 in which a plurality of punches 91 are arranged at uniform interval along with the longitudinal direction of the mold 90 (the arrangement direction A). Eight punch rows 92 are formed in the mold 90 so as to become parallel to each other in the short-lengths direction of the mold 90 (the direction C). A punch group 93 is formed from the eight punch rows 92. The punch group 93 is formed within a trapezoidal region 94 corresponding to the actuator unit 21 and arranged such that positions of the punches 91 at respective ends, among the punches 91 constituting each punch row 92, approach the center in each punch row 92 as the punch rows 92 approach from the longer side to the shorter side of the trapezoidal region 94. The mold 90 has four punch groups 93 arranged in a staggered pattern along with the arrangement direction A, and trapezoidal regions 94 of the respective punch groups 93 are formed so as to face the trapezoidal regions of the four nozzle groups 51.

Outlines of the respective nozzle-row sets 53 shown in FIG. 7 are provided in FIG. 11. One punch row 92 is provided in each frame of the outline. The punch row 92 is arranged in a position corresponding to the plurality of nozzles 8 forming the upper nozzle row 52 in FIG. 7 among the two nozzle rows 52 of the nozzle-row set 53, as well as corresponding to the dummy holes 18 formed in a position continuous with the nozzle row 52. As a result, the plurality of punches 91 are arranged in the arrangement direction A at uniform intervals identical with the pitch between the nozzles forming each nozzle row 52. Specifically, the plurality of punches 91 are arranged at an interval corresponding to 37.5 dpi in the punch row 92 along with the arrangement direction A. In the embodiment, the eight punch rows 92 of the left punch group 93 in FIG. 11 are arranged in positions corresponding to the nozzle rows 52 close to the shorter side of the nozzle group 51 among the nozzle rows 52 forming the nozzle-row set 53 shown in FIG. 7. Moreover, the eight punch rows 92 of the right punch group 93 in FIG. 11 are arranged in positions corresponding to the nozzle rows 52 close to the longer side of the nozzle group 51 among the nozzle rows 52 constituting the nozzle-row set 53. As mentioned above, the eight punch rows 92 constituting the punch group 93 are arranged in positions corresponding to predetermined single nozzle rows 52 of the two nozzle rows 52 constituting the respective nozzle-row sets 53 and correspond to the plurality of nozzles 8 and the dummy holes 18. Therefore, the number of punches formed in the mold 90 is reduced to about one-half the number of nozzles, thereby diminishing costs for manufacturing the mold 90.

As shown in FIG. 12, a pressing machine 101 has an upper jig 105*a* on which the mold 90 is mounted; an XY table 107 having a support section 106 for horizontally supporting a substrate 99, which is to become the nozzle plate 30 as a result of formation of the nozzles 8; a mold 103 in which through holes 103*a* are formed at positions facing the punch groups 93 of the mold 90; a lower jig 105*b* on which the mold 103 is mounted; and a main body 101*a* for supporting the lower jig 105*b* from below.

The XY table 107 and a driving apparatus 108 for moving the XY table 107 are disposed within the main body 101*a*. The driving apparatus 108 can move the XY table 107 in two directions, that is, an X direction parallel to the arrangement direction A (a row direction of the punch rows 92 of the mold 90) and a Y direction parallel to the direction C (a direction orthogonal to the row direction of the punch rows 92 of the mold 90). Each of the through holes 103*a* of the mold 103 has an opening area slightly larger than that of the nozzle 8 formed by the punches 91. Therefore, when tentative holes—which are blind holes and are to become the nozzles 8—are formed in the substrate 99 by the punches 91 through pressing, bulging portions projecting downward from the lower surface of the substrate 99 by means of the punches 91 can stay in the corresponding through holes 103*a*, thereby preventing the extremities of the punches 91 from undergoing a heavy load. Therefore, the punches 91 of the mold 90 are less susceptible to fracture.

A process for forming the nozzles 8 in the substrate 99 that is to become the nozzle plate 30 will now be described by reference to FIG. 13. FIG. 13 shows, in an enlarged manner, an area T surrounding portions of four nozzle rows 521, 52*n*, 52*o*, and 52*p* shown in FIG. 7. The mold 90 is fixed to the upper jig 105*a* of the pressing machine 101 such that the punch rows 92 of the punch group 93 of the mold 90 become parallel to the direction X of the X-Y table 107, and the substrate 99 is arranged so as to be horizontally supported by the support section 106 of the XY table 107 and the upper surface of the mold 103. The upper jig 105*a* of the mold 90 is moved downward by means of an unillustrated cylinder, thereby forming, in predetermined positions on the substrate 99, tentative-hole groups (first nozzle hole groups) 121, which are blind holes and are to become the plurality of nozzles 8 corresponding to the upper nozzle rows 52 among the two nozzle rows 52 of the respective nozzle-row sets 53*g*, 53*h* of the region T. Then, the mold 90 is lifted. Thus, there are formed a row of tentative holes which is to become the nozzle row 52 (the upper nozzle row 52 in the respective nozzle-row sets 53 in FIG. 7) close to the short side of the nozzle group 51 among the two nozzle rows 52 of the respective nozzle-row sets 53 shown in FIG. 7. One tentative hole located at one end of the row of tentative holes will later become the dummy hole 18. Only the first nozzle hole group 121 and a second nozzle hole group 122 described later, which are to become the nozzles 8 belonging to the two nozzle-row sets 53*g*, 53*h*, are drawn in FIG. 13. The first nozzle hole groups 121 and the second nozzle hole groups 122, which is to become the nozzles 8 belonging to the other six nozzle-row sets 53, are also formed in the same manner.

Next, the XY table 107 is moved in the direction X to thus move the substrate 99 relative to the mold 90 in a direction 141*a* parallel to the arrangement direction A by a distance corresponding to P1 (the second predetermined distance); and is also moved in the direction Y to thus move the substrate 99 relative to the mold 90 in a direction 141*b* parallel to the direction C by a distance corresponding to P2 (the first predetermined distance). In short, the XY table 107 is moved in the direction Y while being moved in the direction X, to thus move the substrate 99 relative to the mold 90 in a lower left (a first direction) 141 in FIG. 13, which is a composite direction of the arrangement direction A and the direction C. The mold 90 is lowered in a manner similar to that described above, to thus form tentative-hole groups (second nozzle groups) 122 which do not penetrate through the substrate 99 as shown in FIG. 13, and the mold 90 is lifted. Thus, there is formed the tentative-hole row, which is to become the nozzle row 52 (the lower nozzle row 52 of each nozzle-row set 53 in FIG. 7) close to the long side of the nozzle group 51 among the two nozzle rows 52 of the nozzle-row set 53 shown in FIG. 7.

Next, the substrate 99 is removed from the pressing machine 101. Polished are the bulging portions, which project from the lower surface (the surface which is to become the ink ejection surface 70*a*) and are formed at a time when the plurality of tentative groups (the first and second nozzle hole groups) 121, 122 are formed in the substrate 99 by means of the punch group 93 of the mold 90. At this time, a portion of the lower surface of the substrate 99 is removed through polishing together with the bulging portions, thereby finishing the lower surface into a flat surface. The tentative-hole groups 121, 122 formed by the punch group 93 of the mold 90 in the substrate 99 penetrate, to thus form the nozzle groups 51 and the dummy holes 18. Then, the substrate 99 is punched so as to have a rectangular plane surface, to thus manufacture the nozzle plate 30.

According to the method for manufacturing the nozzle plate 30 of the inkjet head 1 of the first embodiment, the tentative groups 121, 122, which are to become the nozzles 8, can be formed in the substrate 99 through a comparatively smaller number of processes while lowering cost accordingly. As a result, the nozzle plate 30 having the plurality of nozzles 8 can be formed. Namely, when the nozzle plate—in which a plurality of nozzles are two-dimensionally arranged—is manufactured through use of a mold having only one punch, pressing must be repeatedly performed in a number of times equal to the number of nozzles, which in turn adds to the number of manufacturing processes. When the nozzle plate is manufactured through use of a mold having punches, which are equal in number to nozzles, cost of the mold is increased. However, according to the first embodiment of the present invention, the number of manufacturing processes is reduced as compared with the case where the nozzle plate is manufactured through use of the mold having only one punch. As compared with the case where a nozzle plate is manufactured through use of a mold having punches in equal number to nozzles, cost of the mold is diminished. Hence, a manufacturing method, which preserves a superior cost balance, can be attained.

As mentioned previously, the inkjet head 1 using the nozzle plate 30 manufactured under the manufacturing method of the present embodiment is called a multi-line head. However, the manufacturing method of the present embodiment cannot always be applied to all nozzle plates of the multi-line head. If the following configuration is adopted as the layout pattern of the nozzles 8 formed in the nozzle plate 30, the manufacturing method of the first embodiment can be applied thereto. Namely, in this pattern, the sixteen nozzle rows 52 are divided into eight nozzle-row sets 53*a* to 53*h*, each nozzle-row set consisting of two nozzle rows 52 maintaining a predetermined positional relationship.

As mentioned above, the nozzle plate 30 of the present embodiment has a configuration unique to the multi-line head. Namely, all of the nozzles 8 belonging to the sixteen nozzle rows 52 are made different in position from each other in the direction of the respective nozzle rows (the arrangement direction A). In addition, a positional relationship between the two nozzle rows 52 belonging to each of the respective nozzle-row sets 53*a* to 53*h* is determined such that a relative distance (the first predetermined distance) in the direction orthogonal to the direction of the nozzle row (the arrangement direction A) is 3Y; such that a deviation distance (the second predetermined distance) of the nozzle 8 in the direction of the nozzle row (the arrangement direction A) is a distance corresponding to 75 dpi; and such that the relative positional relationship between the two nozzle rows 52 belonging to each of the respective eight nozzle-row sets 53*a* to 53*h* becomes equivalent to each other.

The mold 90 has eight punch rows 92 in which the punches 91 are arranged in each punch row at an interval equal to the nozzle pitch of the nozzle row 52. Each of the punch rows 92 is arranged in the position corresponding to a predetermined one of the two nozzle rows 52 constituting the single nozzle-row set 53. As a result, when the processes of the above described manufacturing method are executed to cause the plurality of punches 91 belonging to a single punch row 92 to form all the nozzles 8 belonging to a single nozzle-row set 53, the nozzle plate 30 shown in FIGS. 6 and 7 can be manufactured.

In the nozzle plate 30 manufactured under the method of this embodiment, the plurality of dummy holes (dummy nozzles) 18 are formed in the regions 61 which lie between the adjacent nozzle groups 51 and outside the trapezoidal regions of the nozzle groups 51, as shown in FIG. 7. Even when the nozzle plate 30 is manufactured by means of the previously-described manufacturing method, which involves formation of the dummy holes 18, the nozzle plate 30 of high resolution having the nozzle groups 51 in which the plurality of nozzles 8 are two-dimensionally arranged can be obtained.

Second Embodiment

<Details of Nozzle Plate>

Figure 14:
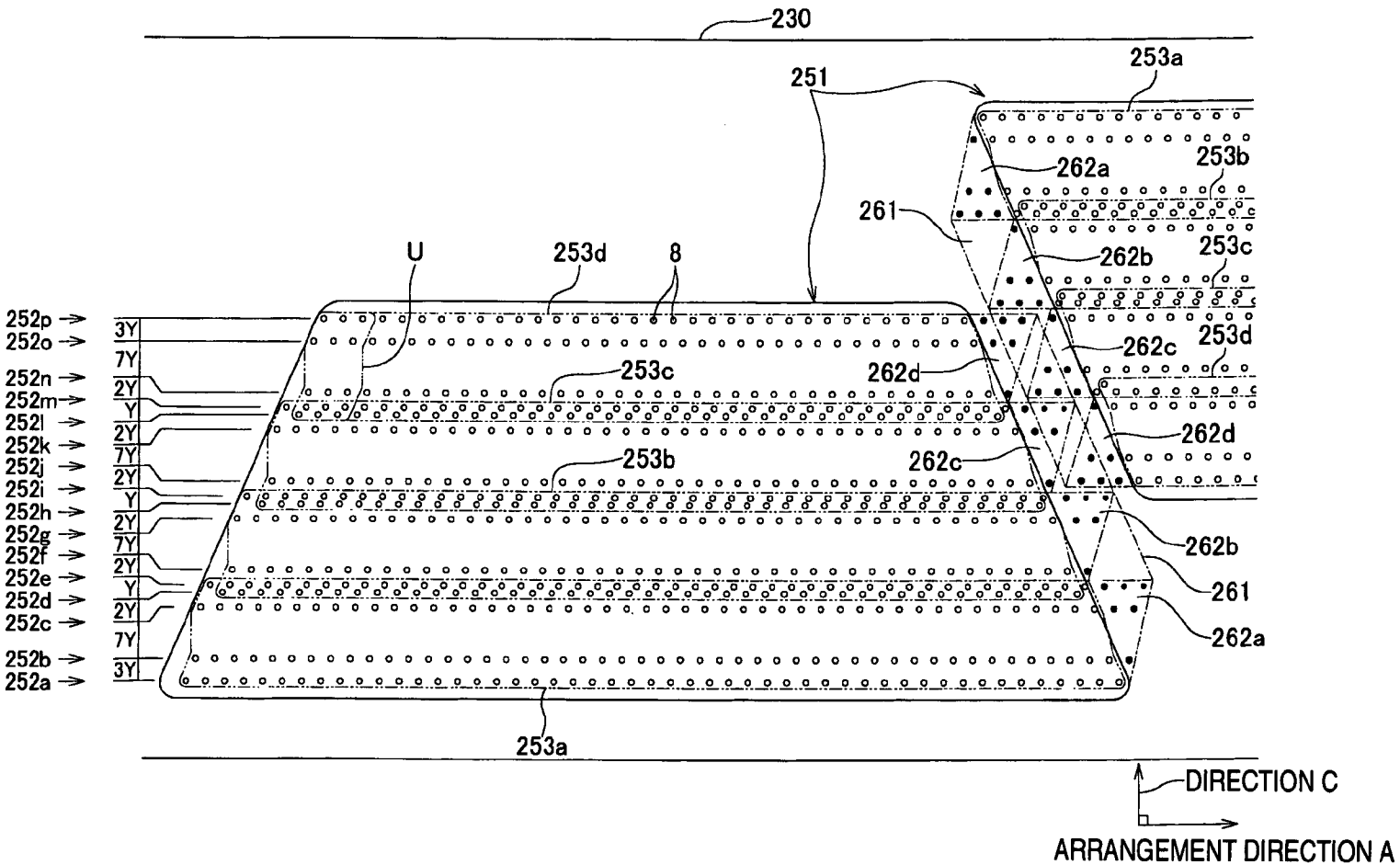
FIG. 14 is a plan view of a nozzle plate of an inkjet head manufactured under a manufacturing method according to a second embodiment of the present invention.

Subsequently, a nozzle plate of an inkjet head manufactured under a manufacturing method according to a second embodiment of the present invention will be described hereunder. FIG. 14 is a plan view of the inkjet head manufactured under the manufacturing method according to the second embodiment of the present invention. Those elements, which are the same as those mentioned previously, are assigned the same reference numerals, and their repeated explanations are omitted.

As shown in FIG. 14, a nozzle plate 230 according to the present embodiment has nozzle groups 251, each group having the same configuration as that of the nozzle group 51 of the nozzle plate 30 according to the first embodiment. Dummy holes 218 formed between the adjacent nozzle groups 251 are provided in greater number than are the previously-described dummy holes 18. Hence, the distance between the adjacent nozzle groups 251 becomes slightly larger. Of sixteen nozzle rows 252 of the nozzle group 251, four nozzle rows 252 are grouped as one set, and hence the nozzle group 251 is divided into four nozzle-row sets 253. The four nozzle-row sets 253 comprise a nozzle-row set 253*a* consisting of a first nozzle row 252*a*, a second nozzle row 252*b*, a third nozzle row 252*c*, and a fifth nozzle row 252*e*; a nozzle-row set 253*b* consisting of a fourth nozzle row 252*d*, a sixth nozzle row 252*f*, a seventh nozzle row 252*g*, and a ninth nozzle row 252*i*; a nozzle-row set 253*c* consisting of an eighth nozzle row 252*h*, a tenth nozzle row 252*j*, an eleventh nozzle row 252*k*, and a thirteenth nozzle row 252*m*; and a nozzle-row set 253*d* consisting of a twelfth nozzle row 2521, a fourteenth nozzle row 252*n*, a fifteenth nozzle row 252*o*, and a sixteenth nozzle row 252*p*. The nozzle rows 252*a* to 252*p* are identical in configuration with the respective nozzle rows 52*a* to 52*p* of the previously-described first embodiment. An interval between the nozzle rows 252*a* to 252*p* is also the same as that between the nozzle rows 52*a* to 52*p*.

Regions 261, which are larger than the previously-described regions 61, exist between the two adjacent nozzle groups 251 along respective oblique sides of the nozzle groups 251. In each region 261, four regions 262*a* to 262*d* separated from each other are present along one oblique side of the nozzle group 251. Dummy holes 218 (holes indicated by solid circles in FIG. 14) analogous to the previously-described dummy holes 18 are formed in the region 262. One or more dummy hole (s) 218 are formed so as to be continuous, in the arrangement direction A, with the plurality of nozzles 8 forming, among the four nozzle rows 252 of each nozzle-row set 253, the three nozzle rows 252 other than the lowest nozzle row 252 in FIG. 14. Six dummy holes 218 are formed in each of the regions 262*a* to 262*d* adjacent to each of the nozzle-row sets 253*a* to 253*d*. Therefore, a plurality of dummy holes 218 pertaining to one nozzle group 251 are formed, in a total number of twenty-four.

In the present embodiment, of the plurality of dummy holes 218, the twenty-four dummy holes 218 continuous with the nozzles 8 of the nozzle rows 252 forming the left nozzle group 251 in FIG. 14 (i.e., the nozzle group 251 whose entirety is illustrated) are formed within a triangular zone (not shown), wherein the triangular zone is defined by subtracting the trapezoidal region of the nozzle group 251 from a parallelogram having as two sides a left oblique side and the longer side of the left nozzle group 251 in FIG. 14. The twenty-four dummy holes 218 continuous with the nozzles 8 of the nozzle rows 252 forming the right nozzle group 251 in FIG. 14 (i.e., the nozzle group 251 whose entirety is not illustrated) are formed within a triangular zone (not shown), wherein the triangular zone is defined by subtracting the trapezoidal region of the nozzle group 251 from a parallelogram having as two sides a right oblique side and the longer side of the right nozzle group 251 in FIG. 14. Thus, the twenty-four dummy holes 218 pertaining to one nozzle group 251 are formed within the triangular zones pertaining to the respective nozzle groups 251, whereby the two regions 261 also fall within the triangular zones. The regions 261 become smaller in area than the triangular zones.

The dummy holes 218 formed in the vicinity of the oblique side of the right nozzle group 251 in FIG. 14 are arranged so that the right nozzle group 251 in FIG. 14 faces a direction opposite to that in which the left nozzle group 251 faces. Hence, the dummy holes 218 formed in the vicinity of the oblique side of the right nozzle group 251 in FIG. 14 are made as if the plurality of dummy holes 218 formed in the vicinity of one oblique side of the left nozzle group 251 shown in FIG. 14 were inverted with respect to the horizontal direction. As mentioned above, the plurality of dummy holes 218, which are greater in number than the previously-described dummy holes 18, are formed in the vicinity of an oblique side of the nozzle group 251. Therefore, as shown in FIG. 14, the interval between the adjacent nozzle groups 251 is slightly larger than the interval between the previously-described adjacent nozzle groups 51. However, as shown in FIG. 14, the two regions 261 of the adjacent nozzle groups 251 are arranged so as to partially overlap each other in the direction C. Hence, the oblique sides of the adjacent nozzle groups 251 can be made close to each other to a certain extent, although not as closely as the previously-described adjacent nozzle groups 51. The reason for this is that the dummy holes 218 do not contribute to ejection of ink, and hence the dummy holes 218 are allowed to be formed in an overlapping manner. By means of the foregoing configuration, the adjacent nozzle groups 251 can be made close to each other in the lateral direction of the nozzle plate 230 (the direction C) in the same manner as mentioned previously while being made close to each other in the longitudinal direction of the nozzle plate 230 (the arrangement direction A). The longitudinal length and lateral length of the nozzle plate 230 can be reduced. In addition, four actuator units to be bonded to the flow path unit can be arranged while maintaining the oblique sides of the adjacent actuator units close to each other. Therefore, the two-dimensional geometry of the entire flow path unit can be reduced, thereby realizing an attempt to miniaturize the inkjet head.

<Method for Manufacturing Nozzle Plate>

Figure 15:
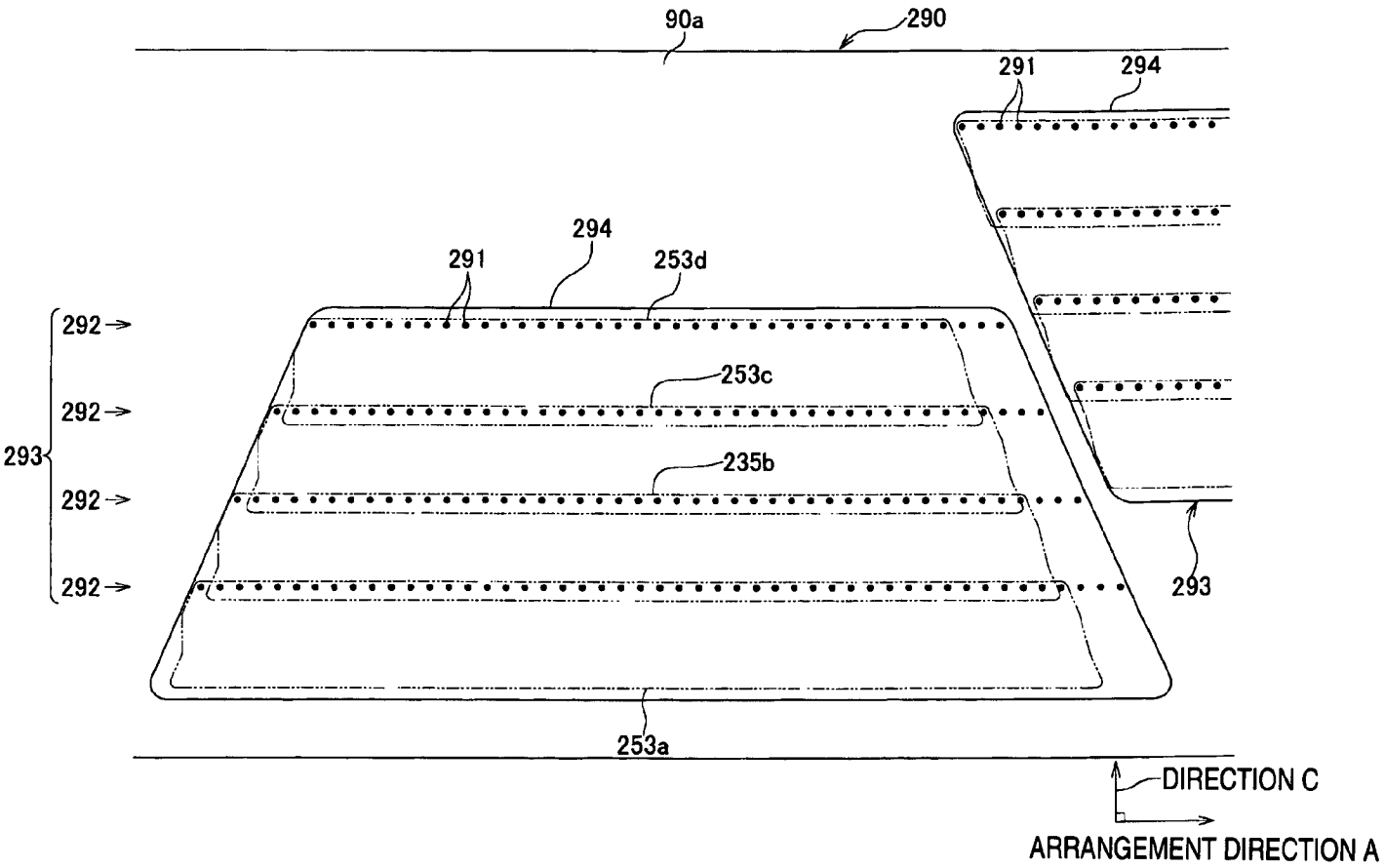
FIG. 15 is a plan view of a part of a mold employed in the manufacturing method according to the second embodiment of the present invention.
Figure 16:
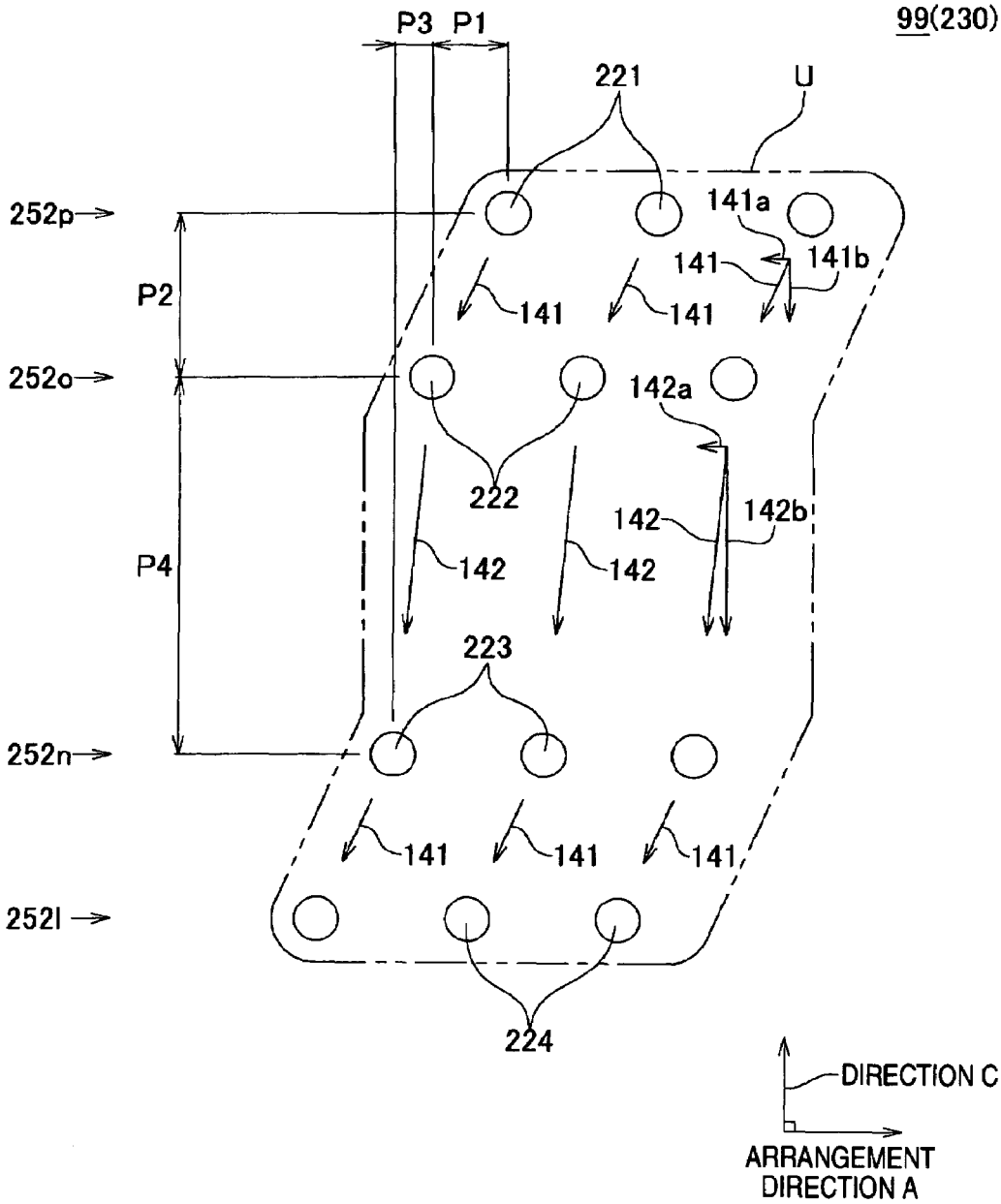
FIG. 16 is a descriptive view showing processes for forming nozzles to be formed in a nozzle plate of the inkjet head according to the second embodiment of the present invention.

A method for manufacturing the nozzle plate 230 of the second embodiment will now be described hereinbelow. FIG. 15 is a plan view showing a part of a mold employed in the manufacturing method according to the second embodiment of the present invention; and FIG. 16 is a descriptive view showing processes for forming nozzles to be formed in the nozzle plate 230 of the inkjet head according to the second embodiment of the present invention; that is, an enlarged view of region U drawn in FIG. 14.

As shown in FIG. 15, a mold 290 has a punch group 293 comprising punches 291, which are smaller in number than the punches 91 constituting the punch group 93 of the previously-described mold 90. In short, the mold 290 has the same configuration as that of the mold 90, except that it has a punch group 293 which is different from the previously-described punch group 93 in terms of a punch layout. The mold 290 has punch rows 292 in which a plurality of punches 291 are arranged at uniform intervals along with the arrangement direction A (the longitudinal direction of the mold 290). Four punch rows 292 are formed in the mold 290 so as to become parallel to each other in the lateral direction of the mold 290 (the direction C). one punch group 293 is formed from the four punch rows 292. The punch group 293 is formed within a trapezoidal region 294 corresponding to the actuator unit 21 and arranged such that positions of the punches at respective ends, among the punches 291 constituting each punch row 292, approach the center in each punch row 292 as the punch rows 292 approach from the longer side to the shorter side of the trapezoidal region 294. The mold 290 has four punch groups 293 arranged in a staggered pattern along with the arrangement direction A. Trapezoidal regions 294 of the respective punch groups 293 are formed so as to face the trapezoidal regions of the four nozzle groups 251 in the same direction.

Outlines of the respective nozzle-row sets 53 shown in FIG. 14 are illustrated in FIG. 15. One punch row 292 is provided in each frame of the outline. The punch row 292 is arranged in a position corresponding to the plurality of nozzles 8 forming the uppermost nozzle row 252 in FIG. 14 among the four nozzle rows 252 of the nozzle-row set 253 as well as corresponding to the dummy holes 218 formed in a position continuous with the nozzle row 252. As a result, the plurality of punches 291 are arranged in the arrangement direction A at the uniform interval identical with the pitch between the nozzles forming each nozzle row 252. Specifically, the plurality of punches 291 are arranged at an interval corresponding to 37.5 dpi in the punch row 292 along with the arrangement direction A. In the embodiment, the four punch rows 292 of the left punch group 293 in FIG. 15 are arranged in positions corresponding to the nozzle rows 252 close to the shorter side of the nozzle group 251 among the nozzle rows 252 forming each nozzle-row set 253 shown in FIG. 14. Moreover, the four punch rows 292 of the right punch group 293 in FIG. 15 are arranged in positions corresponding to the nozzle rows 252 close to the longer side of the nozzle group 251 among the nozzle rows 252 constituting each nozzle-row set 253. As mentioned above, the four punch rows 292 constituting the punch group 293 are arranged in positions corresponding to a single nozzle rows 252 among the four nozzle rows 252 constituting each of the respective nozzle-row sets 253 and correspond to the plurality of nozzles 8 and the dummy holes 218. Therefore, the number of punches 291 formed in the mold 290 is reduced to about one-quarter of the number of nozzles, so that cost for manufacturing the mold 290 is diminished.

A process for forming the nozzles 8 in the substrate 99 that is to become the nozzle plate 230 will now be described with reference to FIG. 16. FIG. 16 shows, in an enlarged manner, an area U surrounding portions of four nozzle rows 252*l*, 252*n*, 252*o*, and 252*p* shown in FIG. 14. The mold 290 is fixed to the upper jig 105*a* of the pressing machine 101 such that the punch rows 292 of the punch groups 293 of the mold 290 become parallel to the direction X of the X-Y table 107, and the substrate 99 is arranged so as to be horizontally supported by the support section 106 of the XY table 107 and the upper surface of the mold 103. The upper jig 105*a* of the mold 290 is moved downward by means of the unillustrated cylinder, thereby forming, in predetermined positions of the substrate 99, tentative-hole groups (first nozzle hole groups) 221, which are blind holes and are to become the plurality of nozzles 8 corresponding to the upper nozzle rows 252*p*, among the four nozzle rows 252 of the respective nozzle-row set 253*d* in the region U, and are blind holes. Then, the mold 290 is lifted. Thus, there are formed a row of tentative holes which are to become the nozzle row 252*p* (the uppermost nozzle rows 252 in the respective nozzle-row sets 253 in FIG. 14) closest to the short side of the nozzle group 251 among the four nozzle rows 252 of the nozzle-row set 253 shown in FIG. 14. Three tentative holes located at one end of the row of tentative holes will later become the dummy hole 218. The first nozzle hole group 221—which is to form the nozzles 8 belonging to the nozzle-row set 253*d*—and second to fourth nozzle hole groups 222 to 224 are only drawn in FIG. 16. However, the first to fourth nozzle hole groups 221 to 224—which are to form the nozzles 8 belonging to the other three nozzle-row sets 253—are also formed in the same manner.

Next, the XY table 107 is moved in the direction X to thus move the substrate 99 relative to the mold 290 in the direction 141*a* parallel to the arrangement direction A by the distance corresponding to P1 (the second predetermined distance); and is also moved in the direction Y to thus move the substrate 99 relative to the mold 290 in the direction 141*b* parallel to the direction C over the distance corresponding to P2 (the first predetermined distance). In short, the XY table 107 is moved in the direction Y while being moved in the direction X, to thus move the substrate 99 relative to the mold 290 in the lower left (the first direction) 141 in FIG. 16, which is a composite direction of the arrangement direction A and the direction C. The mold 290 is lowered in a manner similar to that described previously to thus form the tentative-hole groups (second nozzle groups) 222 which do not penetrate through the substrate 99 as shown in FIG. 16, and the mold 290 is lifted. Thus, there is formed a row of tentative holes which is to become the nozzle row 252*o* (the second from top nozzle row 252 of each nozzle-row set 253 in FIG. 14) located second from the short side of the nozzle group 251 among the four nozzle rows 252 of the nozzle-row set 253 shown in FIG. 14. Two tentative holes located at one end of this row of tentative holes will later become the dummy holes 218.

Next, the XY table 107 is moved in the direction X to thus move the substrate 99 relative to the mold 290 in a direction 142*a* parallel to the arrangement direction A by a distance corresponding to P3; and is also moved in the direction Y to thus move the substrate 99 relative to the mold 290 in a direction 142*b* parallel to the direction C by a distance corresponding to P4. In short, the XY table 107 is moved in the direction Y while being moved in the direction X, to thus move the substrate 99 relative to the mold 290 in a lower left direction (a second direction) 142 in FIG. 16, which is a composite direction of the arrangement direction A and the direction C. Then, the mold 290 is lowered in a similar manner to thus form the tentative-hole groups (third nozzle groups) 223, which do not penetrate through the substrate 99 as shown in FIG. 16, and the mold 290 is lifted. Thus, there is formed a row of tentative holes, which is to become the nozzle row 252*n* (the second from bottom nozzle row 252 of each nozzle-row set 253 in FIG. 14) located second from the long side of the nozzle group 251 among the four nozzle rows 252 of the nozzle-row set 253 shown in FIG. 14. One tentative hole located at one end of this row of tentative holes will later become the dummy holes 218. When consideration is paid to the strip region R shown in FIG. 7, the distance between the nozzle (6) and the nozzle (10) in the arrangement direction A corresponds to the distance P3. More specifically, the distance P3 is a length sufficient for the nozzles (7) to (9) to exist between the nozzles (6) and (10) and is four times the interval corresponding to 600 dpi. Moreover, the distance P4 corresponds to distance 7Y in FIG. 14. Thus, a ratio of P1 to P2 determining the first direction 141 and a ratio of P3 to P4 determining the second direction 142 are evidently different from each other. Therefore, the first direction 141 and the second direction 142 are different from each other and not parallel to each other. Specifically, the second direction 142 is a direction crossing the first direction 141 and the arrangement direction A.

Next, the XY table 107 is moved in the direction X to thus move the substrate 99 relative to the mold 290 in the direction 141*a* parallel to the arrangement direction A over the distance corresponding to P1 (the second predetermined distance); and is also moved in the direction Y to thus move the substrate 99 relative to the mold 290 in the direction 141*b* parallel to the direction C over the distance corresponding to P2 (the first predetermined distance). In short, the XY table 107 is moved in the direction Y while being moved in the direction X, to thus move the substrate 99 relative to the mold 290 in the lower left direction (the first direction) 141 in FIG. 16, which is a composite direction of the arrangement direction A and the direction C. The mold 290 is lowered in a similar manner as before to thus form the tentative-hole groups (fourth nozzle groups) 224, which do not penetrate through the substrate 99 as shown in FIG. 16, and the mold 290 is lifted. Thus, there is formed a row of tentative holes, which is to become the nozzle row 252*l* (the lowest nozzle row 252 of each nozzle-row set 253 in FIG. 14) closest to the short side of the nozzle group 251 among the four nozzle rows 252 of the nozzle-row set 253 shown in FIG. 14.

Next, the substrate 99 is removed from the pressing machine 101, and polished are the bulging portions, which project from the lower surface (the surface which is to become the ink ejection surface 70*a*) and are formed at a time when the plurality of tentative groups (the first to fourth nozzle hole groups) 221 to 224 are formed in the substrate 99 by means of the punch group 293 of the mold 290. At this time, a portion of the lower surface of the substrate 99 is removed through polishing together with the bulging portions, thereby finishing the lower surface into a flat surface. Thereby, the tentative-hole groups 221 to 224 formed in the substrate 99 are penetrated by the punch group 293 of the mold 290, to thus form the nozzle groups 251 and the dummy holes 218. The substrate 99 is punched so as to have a rectangular plane surface, to thus manufacture the nozzle plate 230 where the four nozzle groups 251, each having a trapezoidal region, are formed.

Even the method for manufacturing the nozzle plate 230 of the inkjet head of the second embodiment can achieve the same advantage as that achieved by the manufacturing method of the first embodiment. Specifically, the tentative-hole groups 221 to 224, which are to be the nozzles 8, can be formed in the substrate 99 by means of a comparatively smaller number of processes while the punch groups 293 formed of the plurality of punches 291 in the mold 290 suppresses cost of the mold 290. As a result, the nozzle plate 230 having the plurality of nozzles 8 can be manufactured. In the present embodiment, the number of processes is seen to have increased to about double the number of processes in the first embodiment. However, the number of punches in the mold 290 is reduced to about half the number of punches of the mold 90, and therefore cost of the mold is diminished. Under the method for manufacturing a nozzle plate according to the second embodiment, the time required to manufacture a nozzle plate becomes longer than that required by the method of the first embodiment for manufacturing a nozzle plate. However, the mold becomes inexpensive. For this reason, when priority is placed on reducing cost of a mold, the manufacturing method of the second embodiment is desirable.

In the nozzle plate 230 manufactured under the second method for manufacturing the nozzle plate 230, the plurality of dummy holes 218 (dummy nozzles) are formed in the region 261, which is located between the adjacent nozzle groups 251 and is apart from the trapezoidal region of the nozzle group 251, as shown in FIG. 14. Even when the nozzle plate 230 is manufactured by means of the manufacturing method involving formation of the dummy holes 218, the nozzle plate 230 of a high resolution having the nozzle groups 251 in which the plurality of nozzles 8 are two-dimensionally arranged can be obtained.

In the manufacturing methods described in the first and second embodiments, the first direction may be any direction, so long as the first direction crosses a direction parallel to the nozzle rows. The second direction may also be any direction, so long as the second direction crosses the first direction and the direction parallel to the nozzle rows. The nozzle groups 51, 251 of the nozzle plates 30, 230 have the nozzle-row sets 53, 253 formed from the two nozzle rows 52 and the four nozzle rows 252. However, the nozzle rows may have a plurality of nozzle-row sets consisting of three nozzle rows or five or more nozzle rows. A plurality of nozzles may be formed in the same manner as in the nozzle plate manufacturing method, through use of a mold having a plurality of punches rows corresponding to one of the three, five, or more nozzle rows of the nozzle-row sets. As a result, nozzle groups having nozzle-row sets consisting of the three, five or more nozzle rows can be formed.

Third Embodiment

<Details of Nozzle Plate>

Figure 17:
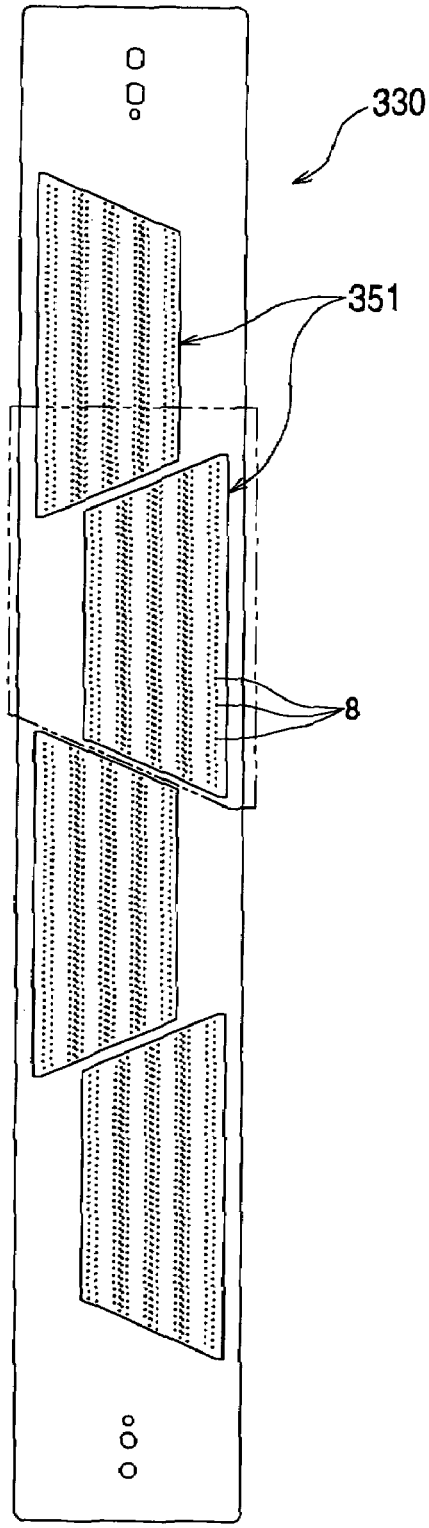
FIG. 17 is a plan view of a nozzle plate according to a third embodiment.
Figure 18:
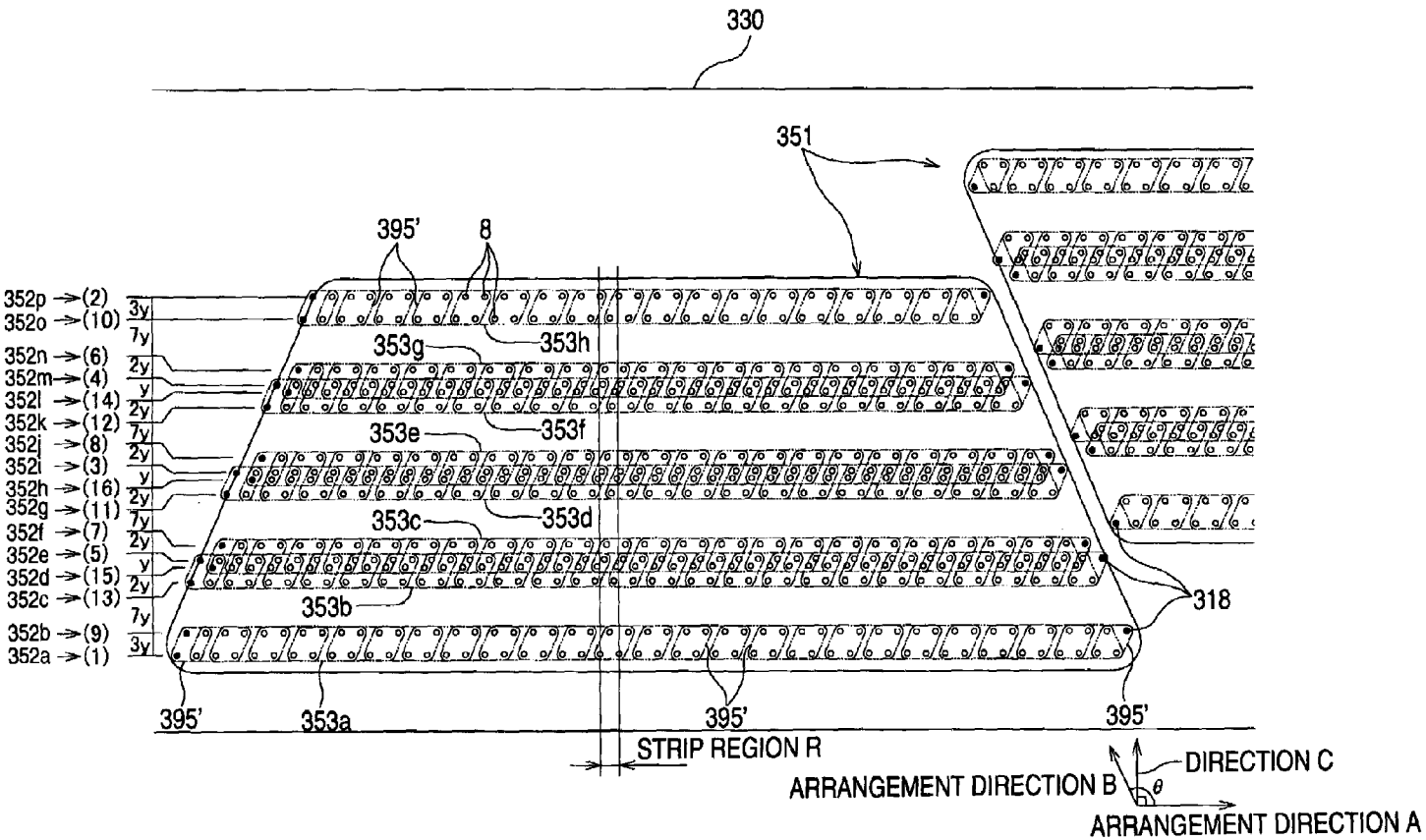
FIG. 18 is an enlarged plan view of an area enclosed by a chain double-dashed line shown in FIG. 17.

Subsequently, a nozzle plate of an inkjet head manufactured under a manufacturing method according to a third embodiment of the present invention will be described hereunder. FIG. 17 is a plan view of a nozzle plate manufactured under the manufacturing method according to the third embodiment of the present invention. FIG. 18 is an enlarged plan view of an area enclosed by a chain double-dashed line shown in FIG. 17. Those elements, which are the same as those mentioned previously, are assigned the same reference numerals, and their repeated explanations are omitted.

As shown in FIG. 18 a nozzle plate 330 according to the third embodiment has nozzle groups 351, each group having a similar configuration to that of the nozzle group 51 of the nozzle plate 30 according to the first embodiment, except for that dummy holes 318 may be continuous with not only one end of nozzle rows 352 but also the other end of the nozzle rows 352.

In the nozzle group 351, the sixteen nozzle rows 352 are divided into eight nozzle-row sets 353 by taking two nozzle rows 3352 as a single set. The eight nozzle-row sets 353 are constituted of: a nozzle-row set 353*a* consisting of the first and second nozzle rows 352*a* and 352*b*; a nozzle-row set 353*b* consisting of the third and fifth nozzle rows 352*c* and 352*e*; a nozzle-row set 353*c* consisting of the fourth and sixth nozzle rows 352*d* and 352*f*; a nozzle-row set 353*d* consisting of the seventh and ninth nozzle rows 352*g* and 352*i*; a nozzle-row set 353*e* consisting of the eighth and tenth nozzle rows 352*h* and 352*j*; a nozzle-row set 353*f* consisting of the eleventh and thirteenth nozzle rows 352*k* and 352*m*; a nozzle-row set 353*g* consisting of the twelfth and fourteenth nozzle rows 352*l* and 352*n*; and a nozzle-row set 353*h* consisting of the fifteenth and sixteenth nozzle rows 352*o* and 352*p*. The distance between the nozzle rows 352 belonging to the respective eight nozzle-row sets 353 is uniform in a direction (direction C) orthogonal to the arrangement direction A, and the distance (a first predetermined distance) is set to 3Y.

Figure 25:
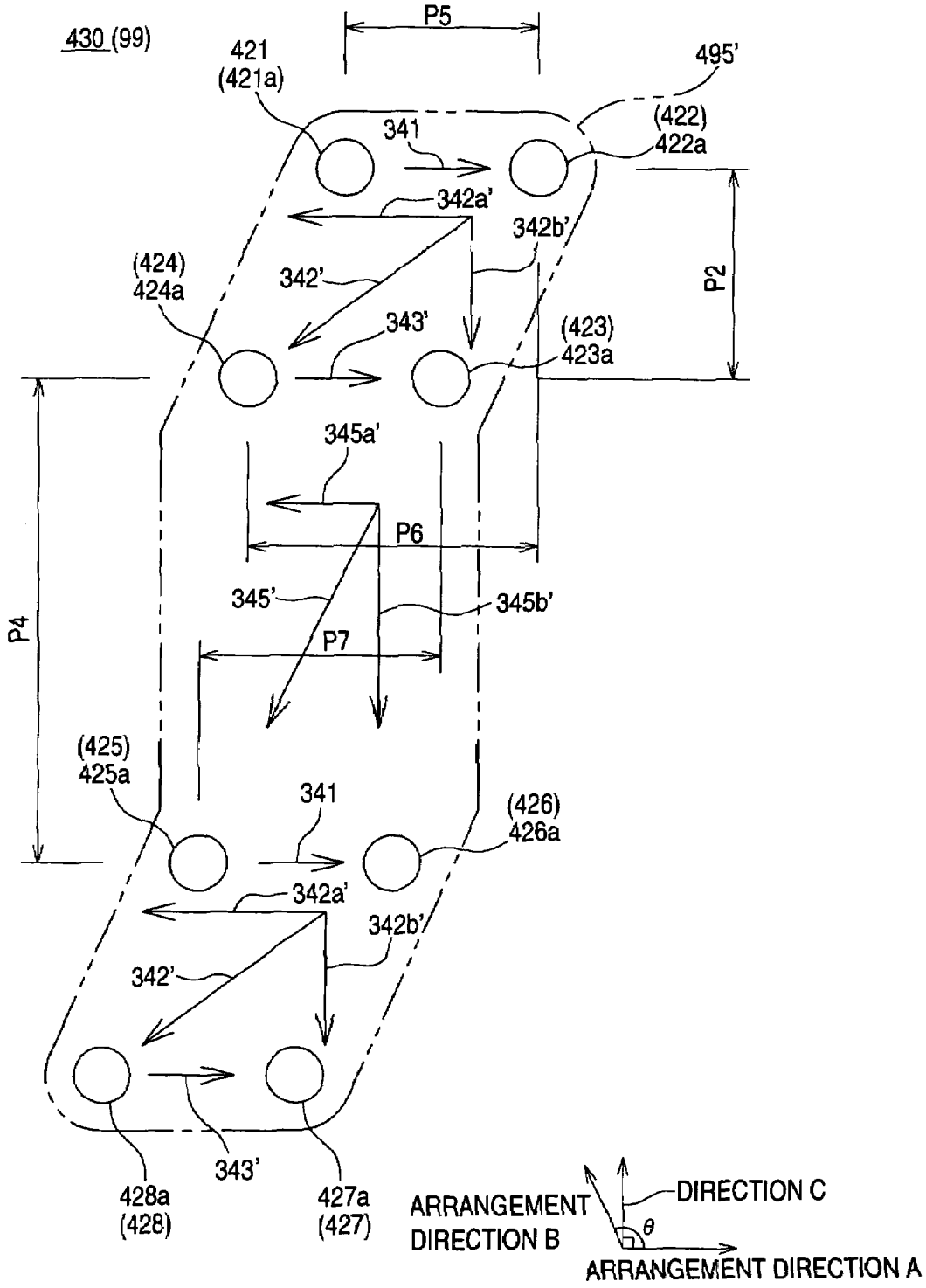
FIG. 25 is a descriptive view showing a modification of the sequence in which nozzles to be formed in the nozzle plate of the inkjet head according to the fourth embodiment of the present invention are formed.

According to the manufacturing method to be described later, only one dummy hole 318 is formed in each end or in one end of each nozzle rows 352 in the arrangement direction A. Hence, oblique sides of the two adjacent nozzle groups 351 can be caused to approach each other to such an extent that the dummy holes 318 do not interfere with the nozzles 8 of the adjacent nozzle group 51. More specifically, as shown in FIG. 25, the adjacent nozzle groups 351 can be caused to approach in the lateral direction (direction C) of the nozzle plate 330 while approaching in the longitudinal direction (arrangement direction A) of the nozzle plate 330. As a result, the length of the nozzle plate 330 can be reduced in both longitudinal and lateral directions thereof. With this configuration, the adjacent nozzle groups 351 can be made close to each other in the lateral direction of the nozzle plate 330 (the direction C) in the same manner as mentioned previously while being made close to each other in the longitudinal direction of the nozzle plate 330 (the arrangement direction A). In addition, four actuator units 21 bonded to the flow passage unit 4 can also be arranged such that the oblique sides of the adjacent actuator units 21 approach each other. As a result, the plane region of the entire flow passage unit 4 can be reduced, thereby enabling an attempt to miniaturize the inkjet head 1. A manufacturing method for forming the nozzles 8 and the dummy holes 318 in the nozzle plate 330 will be described later.

<Method for Manufacturing Nozzle Plate>

Figure 19:
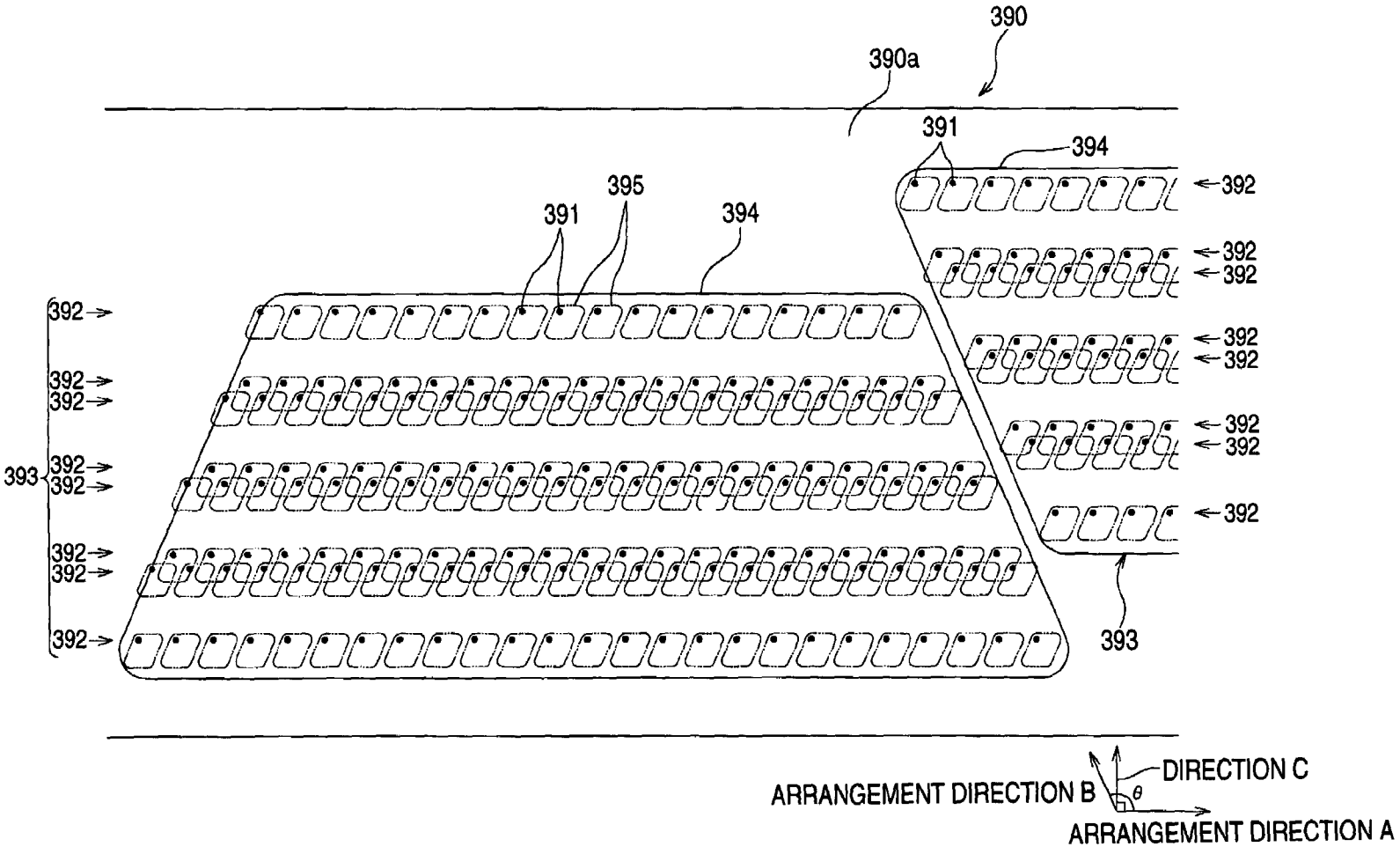
FIG. 19 is a plan view of a part of a mold employed in the manufacturing method according to the third embodiment of the present invention.

As shown in FIG. 19, a single punch 391 is disposed in each of the plurality of parallelogrammic regions 395 and at a position in the vicinity of a left obtuse-angle area of each region 395. As shown in FIG. 25, the regions 395 correspond to regions 395'. The regions 395' are drawn such that four nozzles 8 belonging to the nozzle-row set 353 are arranged in the neighborhoods of four corners of each region 395 and such that a total of four holes, which are combination of the nozzles 8 and the dummy holes 318 belonging to the nozzle-row set 353 are arranged in the neighborhoods of the four corners. As a result, the plurality of punches 391 are arranged at a uniform interval, which is double the pitch between the nozzles 8 constituting each nozzle row 352. In other words, the plurality of punches 391 are arranged along with the arrangement direction A at intervals twice as 37.5 dpi. Also, the punch row 392 is arranged so as to correspond to any one of the two nozzle rows 352 constituting each nozzle-row set 53. In the third embodiment, the eight punch rows 392 of the left punch group 393 in FIG. 19 are arranged in positions corresponding to the nozzle rows 352 close to the shorter side of the nozzle group 351 among the nozzle rows 352 forming the nozzle-row set 353 shown in FIG. 25. Moreover, the eight punch rows 392 of the right punch group 393 in FIG. 19 are arranged in positions corresponding to the nozzle rows 352 close to the longer side of the nozzle group 351 among the nozzle rows 352 constituting the nozzle-row set 353. Thus, the eight punch rows 392 constituting the punch group 393 are arranged in such positions that one punch row 392 corresponds to a predetermined one of the two nozzle rows 352 constituting the nozzle-row set 353. The punch rows 392 correspond to every other one of the plurality of nozzles 8 of the nozzle rows 352. Therefore, the number of punches formed in the mold 390 is reduced to about one-quarter the number of nozzles 8, and hence cost incurred to manufacture the mold 390 is diminished.

Figure 20:
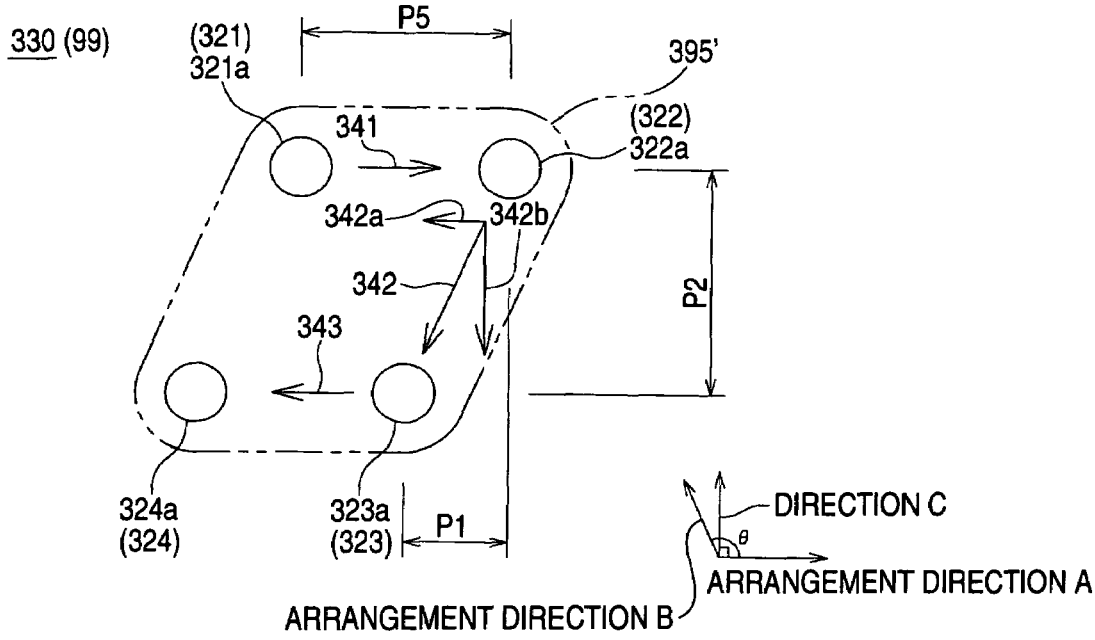
FIG. 20 is a descriptive view showing processes for forming nozzles to be formed in a nozzle plate of the inkjet head according to the third embodiment of the present invention.

When the nozzles 8 are formed in the substrate 99, which is to become the nozzle plate 330, the mold 390 is fixed to the upper jig 105*a* of the pressing machine 101 such that the punch rows 392 of the punch group 393 of the mold 390 become parallel to the direction X of the X-Y table 107, and the substrate 99 is arranged so as to be horizontally supported by the support section 106 of the XY table 107 and the upper surface of the mold 103. The upper jig 105*a* of the mold 390 is moved downward by means of an unillustrated cylinder. As shown in FIG. 20, a tentative-hole group (a first nozzle hole group) 321, which does not penetrate through the substrate 99 is formed in a predetermined position of the substrate 99; that is, an upper left position within each of the regions 395' corresponding to the regions 395, and the mold 390 is lifted. The hole 321*a* belonging to the first hole group 321 and the holes 322*a* to 324*a* belonging to the respective second to fourth nozzle hole groups 322 to 324 described later are each formed in the number of one in FIG. 20. However, in reality, the nozzle hole groups 321 to 324 are formed over the entire regions 395'. Specifically, when the regions 395' are applied to FIG. 25, each of the nozzle hole groups 321 to 324 is simultaneously formed in number greater than one.

Next, the XY table 107 is moved in the direction X to thus move the substrate 99 relative to the mold 390 in a direction 341*a* parallel to the arrangement direction A by a distance corresponding to P5 (a distance equal to the nozzle pitch of the nozzle row 352) shown in FIG. 20. The mold 390 is lowered in a manner similar to that described previously, to thus form a tentative-hole group (a second hole group) 322, which does not penetrate through the substrate 99, as shown in FIG. 20. The mold 390 is then lifted. Thus, there is formed the tentative-hole row, which is to become the nozzle row 352 close to the long side of the nozzle group 351 among the two nozzle rows 352 of the nozzle-row set 353 shown in FIG. 25. Two tentative holes situated at the respective ends of the tentative-hole row will later become the dummy holes 318. The interval between the punches 391 in the punch row 392 of the mold 390 is double the nozzle interval of the nozzle row 352. Hence, the interval between the holes in the tentative-hole row becomes constant.

Next, the XY table 107 is moved in the direction X to thus move the substrate 99 relative to the mold 390 in a direction 342*a* parallel to the arrangement direction A by the distance corresponding to P2 (a second predetermined distance) shown in FIG. 20; and is also moved in the direction Y to thus move the substrate 99 relative to the mold 390 in a direction 342*b* parallel to the direction C by a distance corresponding to P1 (a first predetermined distance) shown in FIG. 20. In short, the XY table 107 is moved in the direction Y while being moved in the direction X, to thus move the substrate 99 relative to the mold 390 in a lower left direction (a second direction) 342 in FIG. 20, which is a composite direction of the arrangement direction A and the direction C. The mold 390 is lowered in a manner similar to that described previously, to thus form tentative-hole groups (third nozzle groups) 323, which do not penetrate through the substrate 99 as shown in FIG. 20, and the mold 390 is lifted.

Next, the XY table 107 is moved in the direction X to thus move the substrate 99 relative to the mold 390 in a direction 343 opposite to the first direction by the distance corresponding to P5, and the mold 390 is lowered in a manner similar to that described previously. As shown in FIG. 20, there is formed a row of tentative holes 324 (a fourth hole group), which does not penetrate through the substrate 99, and the mold 390 is lifted. Thus, there is formed a row of tentative holes, which is to become the nozzle row 352 close to the long side of the nozzle group 351 among the two nozzle rows 352 of the nozzle-row set 353 shown in FIG. 25.

Figure 21:
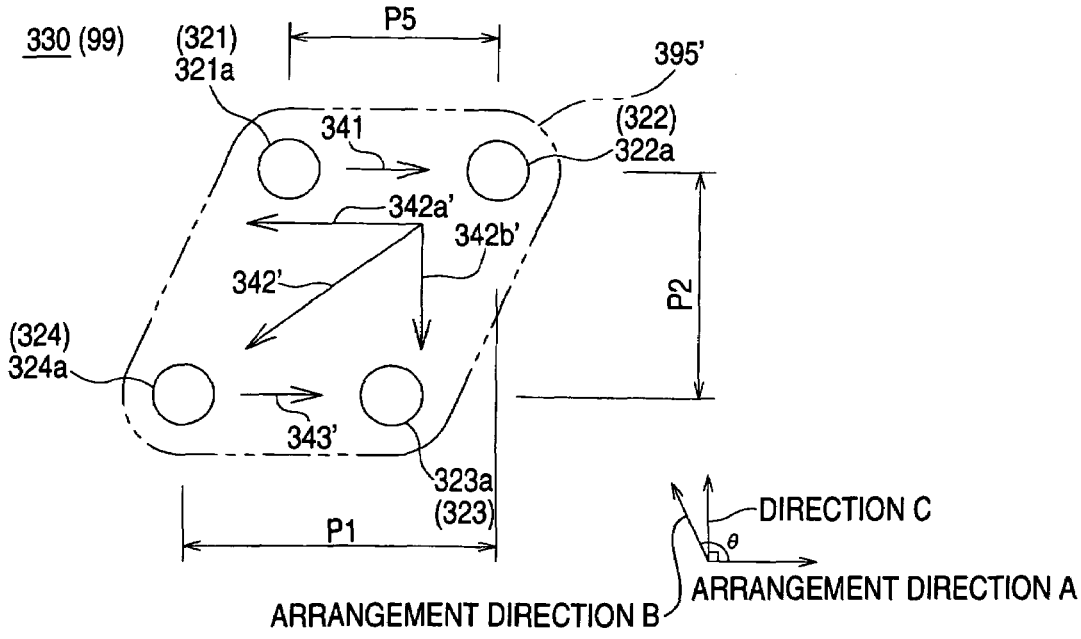
FIG. 21 is a descriptive view showing a modification of the sequence in which nozzles are formed in the nozzle plate of the third embodiment.

As a modification, as shown in FIG. 21, after formation of the second hole group 322*a*, the XY table 107 is moved in the direction X, to thus move the substrate 99 relative to the mold 390 in a direction 342*a'* parallel to the arrangement direction A by the distance corresponding to P6 shown in FIG. 21; and is also moved in the direction Y to thus move the substrate 99 relative to the mold 390 in a direction 342*b'* parallel to the direction C by a distance corresponding to P2 (the first predetermined distance) shown in FIG. 21. More specifically, the XY table 107 is moved in the direction Y while being moved in the direction X, to thus move the substrate 99 relative to the mold 390 in the lower left direction (the second direction) 342' in FIG. 20, which is a composite direction of the arrangement direction A and the direction C. The mold 390 is lowered in a manner similar to that described above, to thus form tentative-hole groups (third nozzle groups) 324, which do not penetrate through the substrate 99, as shown in FIG. 21, and the mold 390 is lifted. Here, as is obvious from FIG. 21, the distance P6 corresponds to the sum of the distance P5 and the distance P1, both of which are shown in FIG. 20. Then, the XY table 107 is moved in the direction X, to thus move the substrate 99 relative to the mold 390 by the distance corresponding to P5 in the same direction (fourth direction) 343' as the first direction. The mold 390 is then lowered in a manner similar to that described above, to thus form a row of tentative holes (a fourth hole group) 323 which does not penetrate through the substrate 99, as shown in FIG. 21, and the mold 390 is again lifted. In this way, there can be formed, in the same manner as mentioned previously, a row of tentative holes, which are to become the nozzle row 352 close to the long side of the nozzle group 351 among the two nozzle rows 352 of the nozzle-row set 353 shown in FIG. 25.

The interval between the punches 391 in the punch row 392 of the mold 390 is double the interval between the nozzles 8 of the nozzle row 352. Thereof, if the mold 390 is moved in the third (fourth) direction by the distance corresponding to P5, the interval between the tentative holes of the tentative-hole row becomes same as the interval between the nozzles 8. Further, it becomes possible to form the first to fourth hole groups 321 to 324, which are to become the nozzles 8, so that the nozzles 8 can be arranged at high density. Of a total of three times the substrate 99 moves relative to the mold 390, the substrate 99 moves parallel to the punch rows 392 twice. Hence, a positional deviation of the nozzles 8 due to an error in the travel of the XY table becomes small. In more detail, the XY table 107 has an error in travel in the X and Y directions. Hence, when the XY table 107 is moved in both the X and Y directions simultaneously, errors in travel become maximum. In the embodiment, the number of times the XY table 107 is moved in two directions; that is, the X and Y directions, simultaneously is small. Hence, errors in the X and Y directions of the XY table 107 exert less influence, and consequently, deviations in the positions of the nozzles 8 can be minimized.

Next, the substrate 99 is removed from the pressing machine 101, and polished are the bulging portions, which project from the lower surface (the surface which is to become the ink ejection surface 70*a*) of the substrate 99 and are formed at a time when the plurality of tentative groups (the first to fourth nozzle hole groups) 321 to 324 are formed in the substrate 99 by means of the punch group 393 of the mold 390. At this time, a portion of the lower surface of the substrate 99 is removed through polishing along with the bulging portions, thereby finishing the lower surface into a flat surface. The tentative-hole groups 321 to 324 formed in the substrate 99 by the punch group 393 of the mold 390 are penetrated, to thus form the nozzles 8 and the dummy holes 318. The substrate 99 is punched so as to have a rectangular plane surface, to thus manufacture the nozzle plate 330.

According to the method for manufacturing the nozzle plate 330 of the inkjet head 1 of the third embodiment, the tentative groups 321 to 324, which are to become the nozzles 8, can be formed in the substrate 99 through a comparatively smaller number of processes while lowering cost accordingly. As a result, the nozzle plate 330 having the plurality of nozzles 8 can be formed. Namely, when the nozzle plate—in which a plurality of nozzles are two-dimensionally arranged—is manufactured through use of a mold having only one punch, pressing must be repeatedly performed in a number of times equal to the number of nozzles, which in turn adds to the number of manufacturing processes. When the nozzle plate is manufactured through use of a mold having punches, which are equal in number to nozzles, cost of the mold is increased. However, according to the first embodiment of the present invention, the number of manufacturing processes is reduced as compared with the case where the nozzle plate is manufactured through use of the mold having only one punch. As compared with the case where a nozzle plate is manufactured through use of a mold having punches in equal number to nozzles, cost of the mold is diminished. Hence, a manufacturing method, which preserves a superior cost balance, can be attained.

As mentioned previously, the inkjet head 1 using the nozzle plate 330 manufactured under the manufacturing method of the third embodiment is called a multi-line head. However, the manufacturing method of the third embodiment cannot always be applied to all nozzle plates of the multi-line head. If the following configuration is adopted as the layout pattern of the nozzles 8 formed in the nozzle plate 330, the manufacturing method of the third embodiment can be applied thereto. Namely, in this pattern, the sixteen nozzle rows 352 are divided into eight nozzle-row sets 353*a* to 353*h*, each nozzle-row set consisting of two nozzle rows 352 maintaining a predetermined positional relationship.

As mentioned above, the nozzle plate 330 of the third embodiment has a configuration unique to the multi-line head. Namely, all of the nozzles 8 belonging to the sixteen nozzle rows 352 are made different in position from each other in the direction of the respective nozzle rows (the arrangement direction A). In addition, a positional relationship between the two nozzle rows 352 belonging to each of the respective nozzle-row sets 353*a* to 353*h* is determined such that a relative distance (the second predetermined distance) in the direction orthogonal to the direction of the nozzle row (the arrangement direction A) is 3Y; such that a deviation distance (the first predetermined distance) of the nozzle 8 in the direction of the nozzle row (the arrangement direction A) is a distance corresponding to 75 dpi; and such that the relative positional relationship between the two nozzle rows 352 belonging to each of the respective eight nozzle-row sets 353*a* to 353*h* becomes equivalent to each other.

The mold 390 has eight punch rows 392 in which the punches 391 are arranged in each punch row at an interval twice as the nozzle pitch of the nozzle row 352. Each of the punch rows 392 is arranged in the position corresponding to a predetermined one of the two nozzle rows 352 constituting the single nozzle-row set 353. As a result, when the processes of the above described manufacturing method are executed to cause the plurality of punches 391 belonging to a single punch row 392 to form all the nozzles 8 belonging to a single nozzle-row set 353, the nozzle plate 330 shown in FIGS. 17 and 18 can be manufactured.

Fourth Embodiment

<Details of Nozzle Plate>

Figure 22:
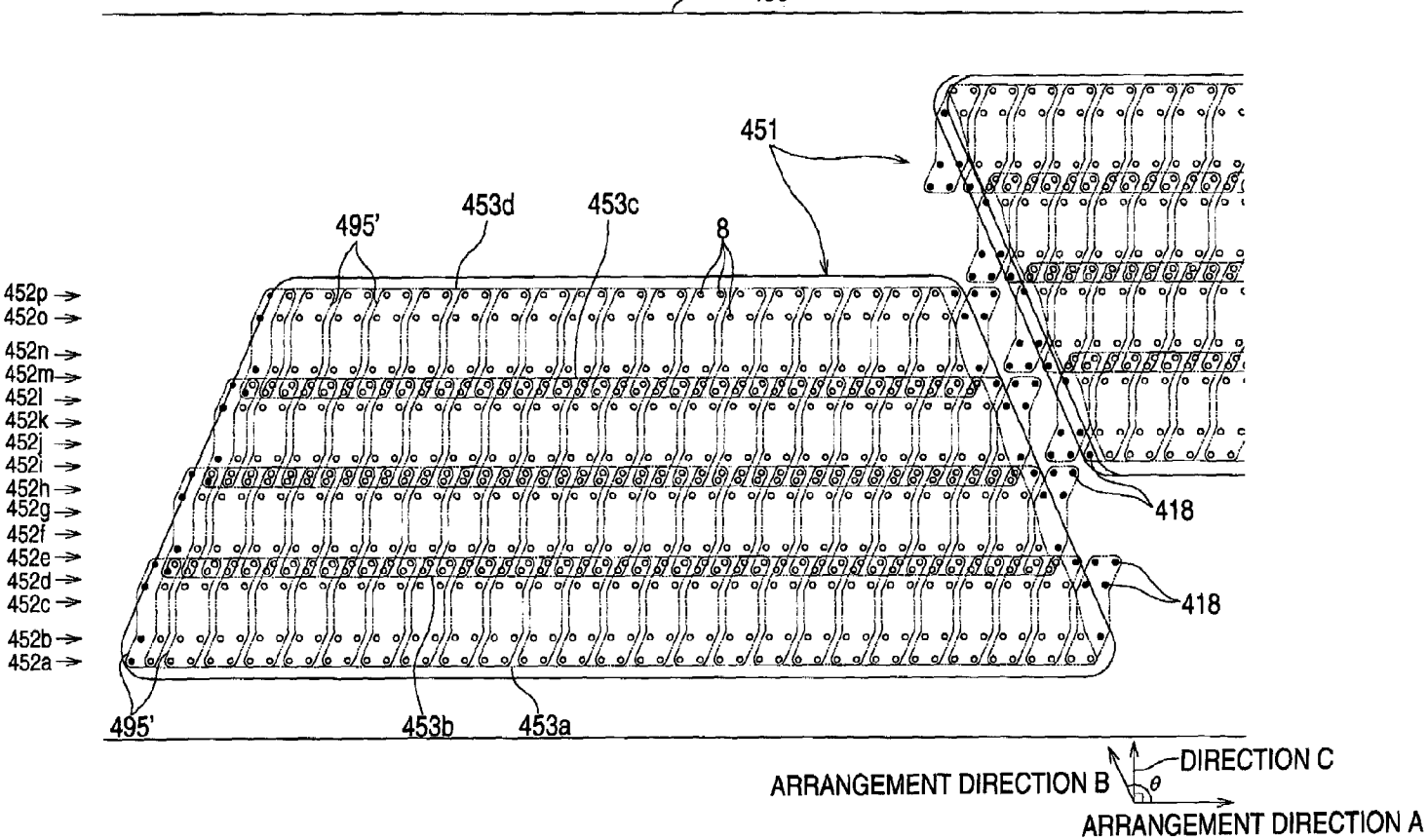
FIG. 22 is a plan view of a nozzle plate of an inkjet head manufactured under a manufacturing method according to a fourth embodiment of the present invention.

Subsequently, a nozzle plate of an inkjet head manufactured under a manufacturing method according to a fourth embodiment of the present invention will be described hereunder. FIG. 22 is a plan view of the inkjet head manufactured under the manufacturing method according to the fourth embodiment of the present invention. Those elements, which are the same as those mentioned previously, are assigned the same reference numerals, and their repeated explanations are omitted.

As shown in FIG. 22, a nozzle plate 430 according to the fourth embodiment has nozzle groups 451, each group having the same configuration as that of the nozzle group 351 of the nozzle plate 330 according to the third embodiment. Dummy holes 418 formed between the adjacent nozzle groups 451 are provided in greater number than are the dummy holes 318 described above. Hence, the distance between the adjacent nozzle groups 451 becomes slightly larger. Of sixteen nozzle rows 452 of the nozzle group 451, four nozzle rows 452 are grouped as one set, and hence the nozzle group 451 is divided into four nozzle-row sets 453. The four nozzle-row sets 453 has a nozzle-row set 453*a* consisting of a first nozzle row 452*a*, a second nozzle row 452*b*, a third nozzle row 452*c*, and a fifth nozzle row 452*e*; a nozzle-row set 453*b* consisting of a fourth nozzle row 452*d*, a sixth nozzle row 452*f*, a seventh nozzle row 452*g*, and a ninth nozzle row 452*i*; a nozzle-row set 453*c* consisting of an eighth nozzle row 452*h*, a tenth nozzle row 452*j*, an eleventh nozzle row 452*k*, and a thirteenth nozzle row 452*m*; and a nozzle-row set 453*d* consisting of a twelfth nozzle row 452*l*, a fourteenth nozzle row 452*n*, a fifteenth nozzle row 452*o*, and a sixteenth nozzle row 452*p*. The nozzle rows 452*a* to 452*p* are identical in configuration with the respective nozzle rows 352*a* to 352*p* of the third embodiment. An interval between the nozzle rows 452*a* to 452*p* is also the same as that between the nozzle rows 352*a* to 352*p*.

Dummy holes 418 (holes indicated by solid circles in FIG. 22) are formed in the vicinity of the oblique side of the nozzle group 451 to be continuous along the nozzles B of the respective nozzle rows 452 and the arrangement direction A. One or more dummy hole(s) 418 are formed in both ends or one end of the respective nozzle rows 452 in the arrangement direction A. Specifically, the plurality of dummy holes 418 are formed in the vicinity of the oblique side of the nozzle group 451 (the nozzle group 451 whose entirety is illustrated in FIG. 22) shown in the left of FIG. 22 so that one dummy hole 418 is formed at each of the left ends of the first nozzle row 452*a*, the fourth nozzle row 452*d*, the eighth nozzle row 452*h*, and the twelfth nozzle row 452*l*; one dummy hole 418 is formed at each of both ends of the second nozzle row 252*b*, the sixth nozzle row 252*f*, the tenth nozzle row 252*j*, and the fourteenth nozzle row 252*l*; one dummy hole 418 is formed at each of the left ends of the third nozzle row 452*c*, the seventh nozzle row 452*g*, the eleventh nozzle row 452*k*, and the fifteenth nozzle row 452*o* and two dummy holes 418 are formed at each of the right ends of the third nozzle row 452*c*, the seventh nozzle row 452*g*, the eleventh nozzle row 452*k*, and the fifteenth nozzle row 452*o*; and one dummy hole 418 is formed at each of the left ends of the fifth nozzle row 452*e*, the ninth nozzle row 452*l*, the thirteenth nozzle row 452*m*, and the sixteenth nozzle row 452*p* and three dummy holes 418 are formed at each of the right ends of the fifth nozzle row 452*e*, the ninth nozzle row 452*l*, the thirteenth nozzle row 452*m*, and the sixteenth nozzle row 452*p*. These dummy holes 418 are formed at a time when the nozzles 8 are formed in the nozzle plate 430. The dummy holes 418 are not in communication with the individual ink flow paths 7. The dummy holes 418 formed in the vicinity of the oblique side of the nozzle group 451 (the nozzle group 451 partially shown in FIG. 22) in the right of FIG. 22 are oriented in the direction opposite to that of the nozzle group 451 on the left of the right nozzle group 451 in FIG. 22. Hence, the plurality of dummy holes 418 formed in the vicinity of the oblique side of the left nozzle group 451 in FIG. 22 are formed as if they were inverted with respect to the horizontal direction. Thus, the plurality of dummy holes 418 are formed in the vicinity of the oblique side of one nozzle group 451 in greater number than are the dummy holes 318. Hence, the interval between the adjacent nozzle groups 451 is slightly greater than the interval between the adjacent nozzle groups 351 of the third embodiment shown in FIG. 25. Therefore, the nozzle plate 430 becomes slightly larger than that of the third embodiment. However, as will be described later, the number of punches used in the mold 490 can be made smaller than the number of punches used in the mold 390 of the third embodiment. Hence, the nozzle plate 430 is advantageous in terms of cost of the mold. Therefore, when no strict miniaturizing limitations are imposed on manufacture of the nozzle plate 430 and there is a request for reducing costs of the mold, adoption of the fourth embodiment is desirable.

<Method for Manufacturing a Nozzle Plate>

Figure 23:
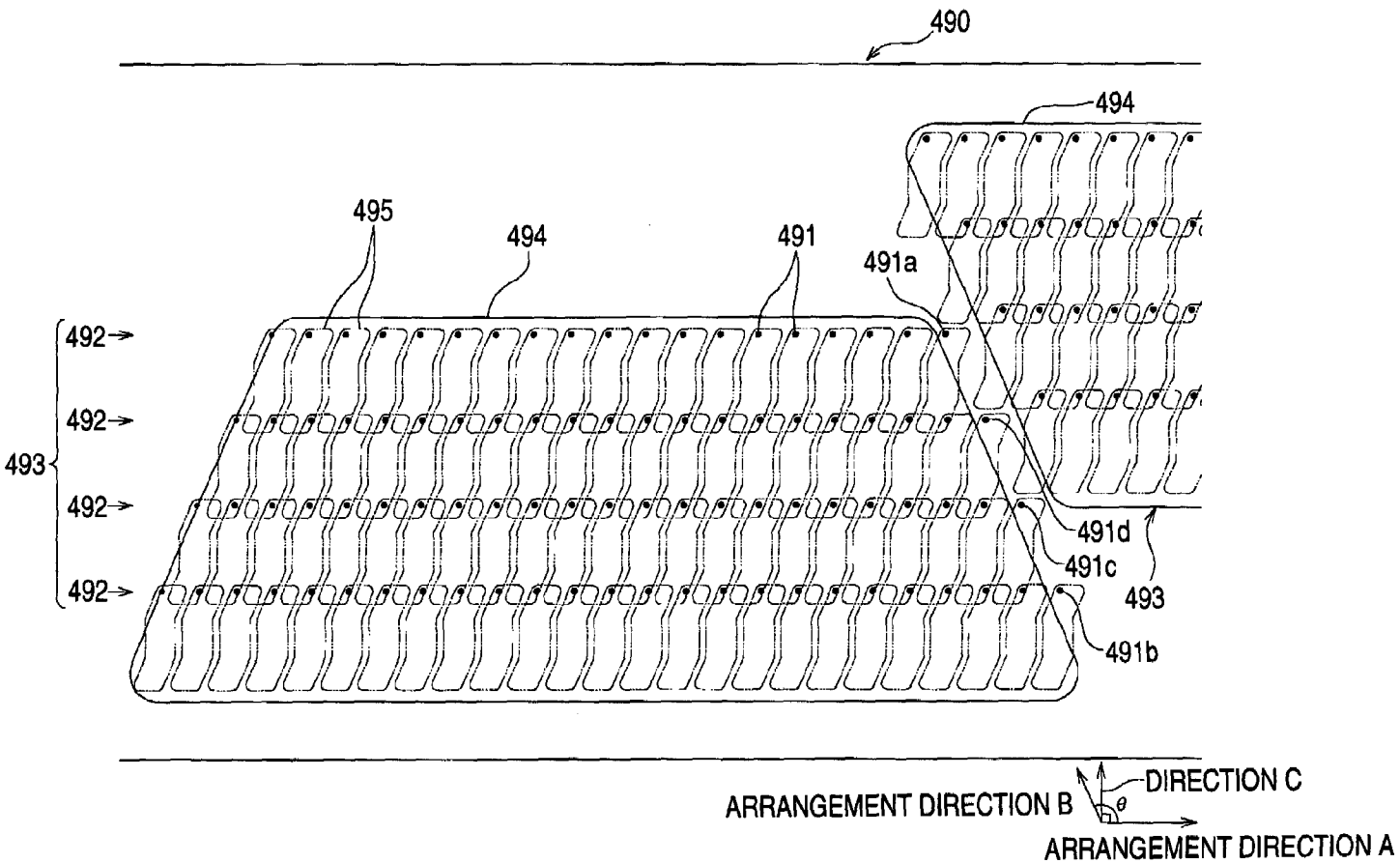
FIG. 23 is a plan view of a portion of a mold employed in the manufacturing method according to the fourth embodiment of the present invention.
Figure 24:
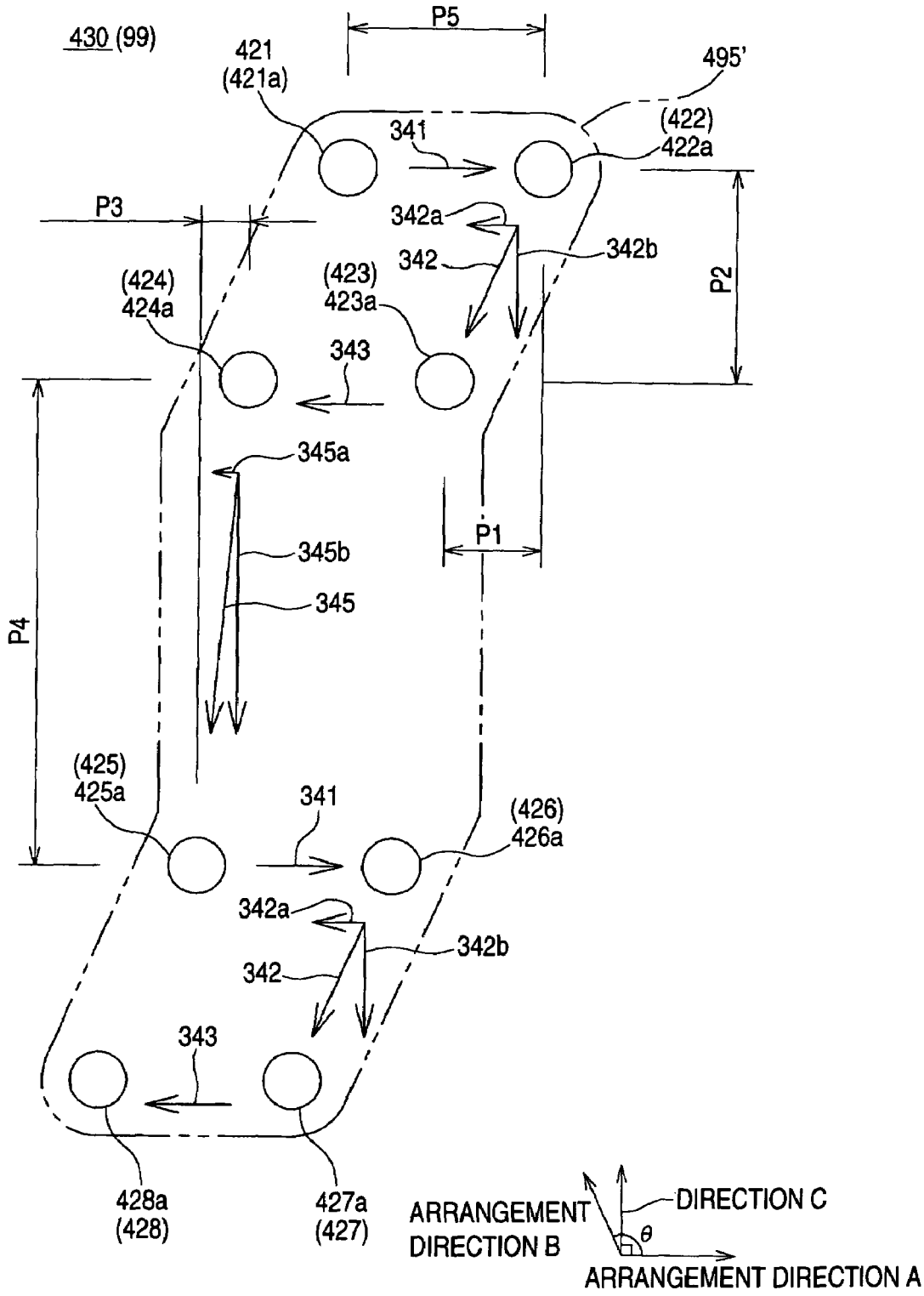
FIG. 24 is a descriptive view showing sequence in which nozzles to be formed in the nozzle plate of the inkjet head according to the fourth embodiment of the present invention are formed.

Next, a method for manufacturing the nozzle plate 430 will be described hereunder. FIG. 23 is a plan view of a portion of a mold employed in the manufacturing method according to the fourth embodiment of the present invention. FIG. 24 is a descriptive view showing sequence in which nozzles to be formed in the nozzle plate of the inkjet head according to the fourth embodiment are formed. FIG. 25 is a descriptive view showing a modification of the sequence in which nozzles to be formed in the nozzle plate of the inkjet head according to the fourth embodiment are formed.

As shown in FIG. 23, a mold 490 has a punch group 493 having punches 491, which are smaller in number than the punches 391 constituting the punch group 393 of the mold 390. In short, the mold 490 has the same configuration as that of the mold 390, except that it has a punch group 493, which is different from the punch group 393 in terms of a punch layout. The mold 490 has punch rows 492 in which a plurality of punches 491 are arranged at uniform intervals along with the arrangement direction A (the longitudinal direction of the mold 490). Four punch rows 492 are formed in the mold 490 so as to become parallel to each other in the lateral direction of the mold 490 (the direction C). One punch group 493 is formed from the four punch rows 492. The punch group 493 is formed within a trapezoidal region 494 corresponding to the actuator unit 21 and arranged such that positions of the punches at respective ends, among the punches 491 constituting each punch row 492, approach the center in each punch row 492 as the punch rows 492 approach from the longer side to the shorter side of the trapezoidal region 494. The trapezoidal region 494 is drawn so as to have the same two-dimensional geometry as that of the trapezoidal region of the nozzle group 451. Hence, the punches 491 are also arranged in positions outside the trapezoidal region 494 in the vicinity of the right oblique side of the left punch group 493 (the punch group 493 whose entirety is shown in FIG. 23) in FIG. 23. In short, four punches 491*a* to 491*d* formed between the adjacent punch groups 493 shown in FIG. 23 are included in the left punch group 493. The punch group 493 of the mold 490 is formed so as to face the trapezoidal region of the nozzle group 451 of the nozzle plate 430.

As shown in FIG. 23, one punch 491 is arranged in each of the respective regions 495; namely, in the vicinity of a left obtuse-angle area of each region 495 in FIG. 23. As shown in FIG. 22, the regions 495 correspond to regions 495'. The regions 495' are drawn such that eight nozzles 8 belonging to the single nozzle-row set 453 are arranged in the neighborhoods of eight corners of each region 495' and such that a total of eight holes, which are combination of the nozzles 8 belonging to the single nozzle-row set 453 and the dummy holes 418 are arranged in the neighborhoods of the eight corners. As a result, the plurality of punches 491 are arranged at a uniform interval, which is double the pitch between the nozzles 8 constituting each nozzle row 452. Specifically, the plurality of punches 491 are arranged in the arrangement direction A at an interval, which corresponds to double that corresponding to 37.5 dpi in the punch row 492. The punch rows 492 are arranged so as to correspond to any one of the nozzle rows 452 located at respective ends in the direction C among the four nozzle rows 452 constituting the respective nozzle-row sets 453. In the embodiment, the four punch rows 492 of the left punch group 493 in FIG. 23 are arranged in positions corresponding to the nozzle row 452 closest to the short side of the nozzle group 451 among the nozzle rows 452 constituting the nozzle-row set 453 shown in FIG. 22. Four punches 492 of the right punch group 493 in FIG. 23 (the punch group 493 partially shown in FIG. 23) are arranged in positions corresponding to the nozzle row 452 closest to the long side of the nozzle group 451 among the nozzle rows 452 constituting the nozzle-row set 453. Thus, the four punch rows 492 constituting the punch group 493 are arranged in positions corresponding to one nozzle row 452 of the four nozzle rows 452 that constitute the nozzle-row set 453, as well as corresponding to every other one of the plurality of nozzles 8 of the nozzle rows 452. Therefore, the number of punches 491 formed in the mold 490 becomes about one-eighth the number of nozzles 8, whereby cost incurred to manufacture the mold 490 is diminished.

When the nozzles 8 are formed in the substrate 99 which is to become the nozzle plate 430, the mold 490 is fixed to the upper jig 105*a* of the pressing machine 101 such that the punch rows 492 of the punch group 493 of the mold 490 become parallel to the direction X of the X-Y table 107, and the substrate 99 is arranged so as to be horizontally supported by the support section 106 of the XY table 107 and the upper surface of the mold 103. Then, the upper jig 105*a* of the mold 490 is moved downward by means of an unillustrated cylinder. As shown in FIG. 24, a tentative-hole group (a first nozzle hole group) 421, which does not penetrate through the substrate 99, is formed in a predetermined position of the substrate 99; that is, an upper left position within each of the regions 495' corresponding to the regions 495, and the mold 490 is lifted. The hole 421*a* belonging to the first hole group 421 and the holes 422*a* to 428*a* belonging to the respective second to fourth hole groups 422 to 428 are each formed in the number of one in FIG. 24. However, in reality, the nozzle hole groups 421 to 428 are formed over the entire regions 495'. Specifically, when the regions 495' are applied to FIG. 22, each of the hole groups 421 to 428 are simultaneously formed in a number greater than one each.

Next, the XY table 107 is moved in the direction X to thus move the substrate 99 relative to the mold 490 in a direction 341 (a first direction) parallel to the arrangement direction A by a distance corresponding to P5 (a distance equal to the nozzle pitch of the nozzle row 452) shown in FIG. 24. The mold 490 is lowered in a manner similar to that described previously, to thus form a tentative-hole group (a second hole group) 422, which does not penetrate through the substrate 99 as shown in FIG. 24. The mold 490 is then lifted. Thus, there has been formed the tentative-hole row, which is to become the nozzle row 452 closest to the short side of the nozzle group 451 among the four nozzle rows 452 of the nozzle-row set 453 shown in FIG. 24. The tentative holes situated at respective ends of the tentative-hole row will later become the dummy holes 418. The interval between the punches 491 in the punch row 492 of the mold 490 is double the nozzle interval of the nozzle row 452. Hence, the interval between the holes in the tentative-hole row becomes equal to the interval between the holes of the nozzle row 452.

Next, the XY table 107 is moved in the direction X to thus move the substrate 99 relative to the mold 490 in a direction 342*a* parallel to the arrangement direction A by the distance corresponding to P1 (the second predetermined distance) shown in FIG. 24; and is also moved in the direction Y to thus move the substrate 99 relative to the mold 490 in the direction 342*b* parallel to the direction C by the distance corresponding to P2 (the first predetermined distance) shown in FIG. 24. In short, the XY table 107 is moved in the direction Y while being moved in the direction X, to thus move the substrate 99 relative to the mold 490 in the lower left direction (the second direction) 342 in FIG. 24, which is a composite direction of the arrangement direction A and the direction C. The mold 490 is lowered in a manner similar to that described previously, to thus form tentative-hole groups (third nozzle groups) 423, which do not penetrate through the substrate 99, as shown in FIG. 24, and the mold 490 is lifted.

Next, the XY table 107 is moved in the direction X to thus move the substrate 99 relative to the mold 490 in the direction 343 (third direction) opposite to the first direction by the distance corresponding to P5, and the mold 490 is lowered in a manner similar to that described previously. As shown in FIG. 24, there is formed a row of tentative holes 424 (the fourth hole group), which does not penetrate through the substrate 99, and the mold 490 is lifted. Thus, there has been formed a row of tentative holes, which is to become the nozzle row 452 second closest to the long side of the nozzle group 451 among the four nozzle rows 452 of the nozzle-row set 453 shown in FIG. 22. The tentative holes formed at respective ends of the tentative-hole row will later become the dummy holes 418.

Next, the XY table 107 is moved in the direction X to thus move the substrate 99 relative to the mold 490 in a direction 345*a* parallel to the arrangement direction A by a distance corresponding to P3 shown in FIG. 24; and is also moved in the direction Y to thus move the substrate 99 relative to the mold 490 in a direction 345*b* parallel to the direction C by a distance corresponding to P4 shown in FIG. 24. In short, the XY table 107 is moved in the direction y while being moved in the direction X, to thus move the substrate 99 relative to the mold 490 in a lower left direction 345 in FIG. 24, which is a composite direction of the arrangement direction A and the direction C. The mold 490 is lowered in a manner similar to that described previously, to thus form tentative-hole groups (fifth nozzle groups) 425, which do not penetrate through the substrate 99, as shown in FIG. 24, and the mold 490 is lifted.

Next, the XY table 107 is moved in the direction X to thus move the substrate 99 relative to the mold 490 in the direction 341 (the first direction) parallel to the arrangement direction A by the distance corresponding to P5. The mold 490 is lowered in a manner similar to that described previously. As shown in FIG. 24, there has been formed a row of tentative holes 426 (a sixth hole group), which does not penetrate through the substrate 99, and the mold 490 is lifted. Thus, there is formed a row of tentative holes which is to become the nozzle row 452 second closest to the long side of the nozzle group 451 among the four nozzle rows 452 of the nozzle-row set 453 shown in FIG. 22. The tentative holes formed at respective ends of the tentative-hole row will later become the dummy holes 418.

Next, the XY table 107 is moved in the direction X to thus move the substrate 99 relative to the mold 490 in the direction 342*a* parallel to the arrangement direction A by the distance corresponding to P1; and is also moved in the direction Y to thus move the substrate 99 relative to the mold 490 in the direction 342*b* parallel to the direction C by the distance corresponding to P2. In short, the XY table 107 is moved in the direction Y while being moved in the direction X, to thus move the substrate 99 relative to the mold 490 in the lower left direction (the second direction) 342 in FIG. 24, which is a composite direction of the arrangement direction A and the direction C. The mold 490 is lowered in a manner similar to that described previously, to thus form tentative-hole groups (seventh nozzle groups) 427, which do not penetrate through the substrate 99, as shown in FIG. 24, and the mold 490 is lifted.

Next, the XY table 107 is moved in the direction X to thus move the substrate 99 relative to the mold 490 in the direction 343 (third direction) opposite to the first direction by the distance corresponding to P5, and the mold 490 is lowered in a manner similar to that described previously. As shown in FIG. 24, there is formed a row of tentative holes 428 (an eight hole group), which does not penetrate through the substrate 99, and the mold 490 is lifted. Thus, there has been formed a row of tentative holes, which is to become the nozzle row 452 closest to the long side of the nozzle group 451 among the four nozzle rows 452 of the nozzle-row set 453 shown in FIG. 22. The tentative hole formed at one end of the tentative-hole row will later become the dummy holes 418.

Another case where forming processes of the third to eighth hole groups are modified is now described. As shown in FIG. 25, the XY table 107 is moved in the direction X to thus move the substrate 99 relative to the mold 490 in the direction 342*a*' parallel to the arrangement direction A by the distance corresponding to P6; and is also moved in the direction Y to thus move the substrate 99 relative to the mold 490 in the direction 342*b*' parallel to the direction C by the distance corresponding to P2 (a first predetermined distance). In short, the XY table 107 is moved in the direction Y while being moved in the direction X, to thus move the substrate 99 relative to the mold 490 in the lower left direction (a second direction) 342' in FIG. 25, which is a composite direction of the arrangement direction A and the direction C. The mold 490 is lowered in a manner similar to that described previously to thus form the tentative-hole groups (third nozzle groups) 424, which do not penetrate through the substrate 99, as shown in FIG. 25, and the mold 490 is lifted. As is evident from FIG. 25, P6 being the second predetermined distance is the sum of the distance P5 shown in FIG. 24 and the distance P1. Next, the XY table 107 is moved in the direction X to thus move the substrate 99 relative to the mold 490 in a direction (a fourth direction) 343' identical with the first direction by the distance corresponding to P5, and the mold 490 is lowered in a manner similar to that described previously. As shown in FIG. 25, there is formed a tentative-hole group (a fourth nozzle group) 423, which do not penetrate through the substrate 99, as shown in FIG. 25, and the mold 490 is lifted. Thus, in the same manner as mentioned previously, there has been formed a row of tentative holes which is to become the nozzle row 452 second closest to the short side of the nozzle group 451 among the four nozzle rows 452 of the nozzle-row set 453 shown in FIG. 22.

Next, the XY table 107 is moved in the direction X to thus move the substrate 99 relative to the mold 490 in a direction 345*a*' parallel to the arrangement direction A by the distance corresponding to P7; and is also moved in the direction Y to thus move the substrate 99 relative to the mold 490 in a direction 345*b*' parallel to the direction C by the distance corresponding to P4. In short, the XY table 107 is moved in the direction Y while being moved in the direction x, to thus move the substrate 99 relative to the mold 490 in the lower left direction (a second direction) 345' in FIG. 25, which is a composite direction of the arrangement direction A and the direction C. The mold 490 is lowered in a manner similar to that described previously to thus form the tentative-hole groups (fifth nozzle groups) 425 which do not penetrate through the substrate 99 as shown in FIG. 25, and the mold 490 is lifted. Then, the XY table 107 is moved in the direction X to thus move the substrate 99 relative to the mold 490 in the direction 341 parallel to the arrangement direction A by the distance corresponding to P5. The mold 490 is lowered in a manner similar to that described previously. As shown in FIG. 25, a tentative-hole group (sixth hole group) 426, which does not penetrate through the substrate 99, and the mold 490 is lifted. Thus, in the same manner as mentioned previously, there has been formed a row of tentative holes, which is to become the nozzle row 452 second closest to the long side of the nozzle group 451 among the four nozzle rows 452 of the nozzle-row set 453 shown in FIG. 22.

Next, the XY table 107 is moved in the direction X to thus move the substrate 99 relative to the mold 490 in the direction 342*a*' parallel to the arrangement direction A by the distance corresponding to P6; and is also moved in the direction Y to thus move the substrate 99 relative to the mold 490 in the direction 342*b*' parallel to the direction C by the distance corresponding to P2 (the first predetermined distance). In short, the XY table 107 is moved in the direction Y while being moved in the direction X, to thus move the substrate 99 relative to the mold 490 in the lower left direction (the second direction) 342' in FIG. 25, which is a composite direction of the arrangement direction A and the direction C. The mold 490 is lowered in a manner similar to that described previously to thus form the tentative-hole groups (seventh nozzle groups) 428, which do not penetrate through the substrate 99 as shown in FIG. 25, and the mold 490 is lifted. Then, the XY table 107 is moved in the direction X to thus move the substrate 99 relative to the mold 490 in a direction (a fourth direction) 343' identical with the first direction by the distance corresponding to P5. The mold 490 is lowered in a manner similar to that described previously. As shown in FIG. 25, a tentative-hole group (an eighth hole group) 427, which does not penetrate through the substrate 99, and the mold 490 is lifted. Thus, in the same manner as mentioned previously, there has been formed a row of tentative holes, which is to become the nozzle row 452 closest to the long side of the nozzle group 451 among the four nozzle rows 452 of the nozzle-row set 453 shown in FIG. 22.

Since the interval between the punches in the punch row 492 of the mold 490 is double the interval between the nozzles of the nozzle row 452. Hence, the mold 490 is moved in the first and third directions over the distance of P1, whereupon the interval between the tentative holes of the tentative-hole row becomes constant. Further, it becomes possible to form the first to eighth hole groups 421 to 428, which are to become the nozzles 8 so that the nozzles 8 can be arranged at high density. Of a total of seven times the substrate 99 moves relative to the substrate 490, the substrate 99 moves parallel to the punch rows 492 twice, and hence a positional deviation of the nozzles due to an error in the travel of the XY table becomes small. The number of times the XY table 107 is moved in two directions; that is, the X and Y directions, is small, and hence errors in the X and Y directions of the XY table 107 become less influent. Consequently, an deviation in the positions of the nozzles can be less induced by the errors in the XY table.

Next, the substrate 99 is removed from the pressing machine 101, and polished are the bulging portions, which project from the lower surface of the substrate 99 and are formed at a time when the plurality of tentative groups (the first to eight nozzle hole groups) 421 to 428 are formed in the substrate 99 by means of the punch group 493 of the mold 490. At this time, a portion of the lower surface of the substrate 99 is removed through polishing together with the bulging portions, thereby finishing the lower surface into a flat surface. The tentative-hole groups 421 to 428 formed by the punch group 493 of the mold 490 in the substrate 99 are penetrated, to thus form the nozzles 8 and the dummy holes 418. The substrate 99 is punched so as to have a rectangular plane surface, to thus manufacture the nozzle plate 430 where the nozzle groups 451, each having a trapezoidal region, are formed.

The method the fourth embodiment for manufacturing the nozzle plate 430 of the inkjet head also can achieve the same advantage as that achieved by the manufacturing method of the third embodiment. Specifically, the tentative-hole groups 421 to 428, which are to be the nozzles 8, can be formed in the substrate 99 by means of a comparatively smaller number of processes while cost of the mold is lowered. In the fourth embodiment, the number of processes is seen to have increased to about double the number of processes in the third embodiment. However, the number of punches in the mold 490 is reduced to about half of the punches 391 of the mold 390, and therefore cost of the mold is diminished. Under the method for manufacturing a nozzle plate according to the fourth embodiment, the time required to manufacture a nozzle plate becomes longer than that required by the method for manufacturing a nozzle plate described in the third embodiment. However, the fourth embodiment makes the mold inexpensive. For this reason, when priority is placed on reducing cost of a mold, the manufacturing method of the fourth embodiment is desirable.

In the manufacturing methods described in the third and fourth embodiments, the second direction may be any direction, so long as the second direction crosses the first direction parallel to the nozzle rows. The nozzle groups 351, 451 of the nozzle plates 330, 430 have the nozzle-row sets 353, 453 formed from the two nozzle rows 352 and the four nozzle rows 452. However, the only requirement for the nozzle rows is to have a plurality of nozzle-row sets consisting of three nozzle rows or five or more nozzle rows. Moreover, the essential requirement is that the interval between the punches 391, 491 of the punch rows 392, 492 of the molds 390, 490 should be equal to an integral multiple of the predetermined interval between the nozzle holes of the nozzle row, the integral multiple being two or more.

What is claimed is:

1. A nozzle plate comprising:

a plurality of nozzle groups of a trapezoid, each of the nozzle groups in which a plurality of nozzles for ejecting ink are arranged two dimensionally within the trapezoid on an ink ejection surface; and a plurality of dummy holes; wherein:

each of the nozzle groups has a plurality of nozzle rows in which a plurality of nozzle holes are arranged in a direction of a long side of the trapezoid at predetermined intervals, the nozzle holes and the dummy holes passing through the nozzle plate;

the nozzle groups are arranged so that the long sides thereof are parallel to each other;

oblique sides of adjacent nozzle groups face each other to be parallel to each other;

the oblique sides of the adjacent nozzle groups partially overlap each other when viewed from a direction, which is perpendicular to the long sides and is on the ink ejection surface;

when the nozzle holes of the nozzle groups are projected from a predetermined direction onto a virtual line, which is on a plane including the ink ejection surface and is parallel to the long sides, projection points of the nozzle holes are arranged at even intervals on the virtual line;

the predetermined direction is parallel to the plane including the ink ejection surface; and the dummy holes are arranged on an extension line of the nozzle rows and are located outside the trapezoids of the nozzle groups.

2. The nozzle plate according to claim 1, wherein the dummy holes does not eject ink therefrom.

3. The nozzle plate according to claim 1, wherein the dummy holes have a same shape as the nozzle holes.

4. The nozzle plate according to claim 1, wherein at least one of the dummy holes is arranged on an extension line of the nozzle row located at a shorter side of the trapezoid.

5. A nozzle plate comprising:

a nozzle group of a trapezoid including a plurality of nozzle rows arranged in a direction along a long side of the trapezoid, each nozzle row including a plurality of nozzle holes for ejecting ink arranged at predetermined intervals within the trapezoid, the nozzle holes passing through the nozzle plate, a plurality of dummy holes arranged on extension lines of the nozzle rows and located outside the trapezoid of the nozzle group, the dummy holes passing through the nozzle plate.

6. The nozzle plate according to claim 5, wherein the dummy holes do not eject ink therefrom.

7. The nozzle plate according to claim 5, wherein the dummy holes have a same shape as the nozzle holes.

8. The nozzle plate according to claim 5, wherein at least one of the dummy holes is arranged on an extension line of the nozzle row located at a shorter side of the trapezoid.

* * * * *